US010178915B1

(12) United States Patent
Sternlight et al.

(10) Patent No.: US 10,178,915 B1
(45) Date of Patent: Jan. 15, 2019

(54) TRAVEL PILLOW WITH ANCHORING FEATURES

(71) Applicant: CABEAU, INC., Woodland Hills, CA (US)

(72) Inventors: David Bret Sternlight, Woodland Hills, CA (US); John Edward Wilkening, Capitola, CA (US)

(73) Assignee: CABEAU, INC., Woodland, CA (US)

( * ) Notice: Subject to any disclaimer, the term of this patent is extended or adjusted under 35 U.S.C. 154(b) by 0 days.

(21) Appl. No.: 15/904,400

(22) Filed: Feb. 25, 2018

Related U.S. Application Data

(60) Provisional application No. 62/531,278, filed on Jul. 11, 2017, provisional application No. 62/571,785, filed on Oct. 12, 2017, provisional application No. 62/574,366, filed on Oct. 19, 2017.

(51) Int. Cl.

| | |
|---|---|
| ***A47C 1/10*** | (2006.01) |
| ***A47C 21/02*** | (2006.01) |
| ***A47G 9/10*** | (2006.01) |
| ***A47C 7/38*** | (2006.01) |

(52) U.S. Cl.
CPC ..... *A47C 21/026* (2013.01); *A47C 7/383* (2013.01); *A47G 9/1081* (2013.01)

(58) Field of Classification Search
CPC .. B60N 2/2851; B60N 2/2887; B60N 2/2881; A47G 9/1081; A47G 9/10; A47G 2009/1018; A47C 7/383
USPC ..... 297/392, 397, 393; 5/636, 639
See application file for complete search history.

(56) References Cited

U.S. PATENT DOCUMENTS

| | | | | |
|---|---|---|---|---|
| 2,582,571 A | | 1/1952 | Thoma | |
| 3,604,026 A | | 9/1971 | Scheips | |
| 4,679,263 A | * | 7/1987 | Honer | A47C 7/383 297/393 |
| 5,345,633 A | * | 9/1994 | Harnish | B60N 2/879 5/639 |
| 5,501,508 A | | 3/1996 | Llewellyn | |
| 5,544,378 A | | 8/1996 | Chow | |
| 5,738,640 A | * | 4/1998 | Carlson-Orsi | A61F 5/01 128/845 |

(Continued)

FOREIGN PATENT DOCUMENTS

| | | |
|---|---|---|
| AU | 2003-20182 | 10/2003 |
| CN | 202669553 | 1/2013 |

OTHER PUBLICATIONS

International Search Report and Written Opinion from PCT/US2018/025520 dated Apr. 30, 2018.

*Primary Examiner* — Chi Q Nguyen
(74) *Attorney, Agent, or Firm* — DLA Piper LLP US

(57) ABSTRACT

Travel pillows with anchor mechanisms are disclosed. The travel pillows can including anchor mechanisms with anchor mechanism bodies such as straps. The anchor mechanism bodies can be attached to the travel pillow body, such as to the rear of the travel pillow body, or alternatively can be detachable from the travel pillow body. The anchor mechanisms can also include loops through which the anchor mechanism bodies can pass before reattaching to themselves or attaching to another element such as a cover of the travel pillow body. The anchor mechanism bodies can be placed around a portion of a headrest, such as headrest wings, to prevent or make less likely a user's head and/or body falling forward inadvertently.

19 Claims, 39 Drawing Sheets

(56) References Cited

U.S. PATENT DOCUMENTS

| | | | | |
|---|---|---|---|---|
| 5,800,019 | A | 9/1998 | Knightlinger | |
| 6,435,617 | B1 | 8/2002 | McNair | |
| 6,820,938 | B2 * | 11/2004 | Barrett | A47C 7/022 297/4 |
| 6,957,462 | B1 * | 10/2005 | Wilcox | A47C 7/383 297/393 |
| 7,093,903 | B2 | 8/2006 | O'Connor | |
| D582,713 | S | 12/2008 | Baldwin | |
| 7,627,916 | B1 * | 12/2009 | Gielow | A47C 16/00 297/393 |
| 7,644,990 | B2 | 1/2010 | Pearson | |
| D613,402 | S | 4/2010 | Roberts | |
| 7,865,987 | B2 * | 1/2011 | Deetsch | A47C 16/00 2/468 |
| 7,938,491 | B2 | 5/2011 | Montuore | |
| 8,239,987 | B2 * | 8/2012 | Sharp | A47C 7/383 5/636 |
| 8,321,977 | B1 * | 12/2012 | Kummerfeld | A47D 13/00 248/118 |
| 9,414,691 | B2 | 8/2016 | Blyberg | |
| D769,029 | S | 10/2016 | Okwumabua | |
| 9,572,718 | B2 | 2/2017 | Sternlight | |
| 9,635,962 | B2 | 5/2017 | Sternlight | |
| 2005/0179300 | A1 | 8/2005 | O'Connor | |
| 2006/0250015 | A1 | 11/2006 | Buck | |
| 2007/0180623 | A1 | 8/2007 | Stein | |
| 2010/0133888 | A1 * | 6/2010 | Montuore | B60N 2/2851 297/397 |
| 2011/0204696 | A1 | 8/2011 | Koehler | |
| 2012/0011655 | A1 | 1/2012 | Rojas | |
| 2012/0144590 | A1 * | 6/2012 | Sharp | A47C 7/383 5/639 |
| 2014/0041091 | A1 | 2/2014 | Sternlight | |
| 2014/0310877 | A1 * | 10/2014 | Sternlight | A47G 9/10 5/639 |
| 2015/0059098 | A1 * | 3/2015 | Jung | D05B 93/00 5/636 |
| 2015/0257538 | A1 | 9/2015 | MacDougall | |
| 2017/0135861 | A1 | 5/2017 | Sternlight | |

* cited by examiner

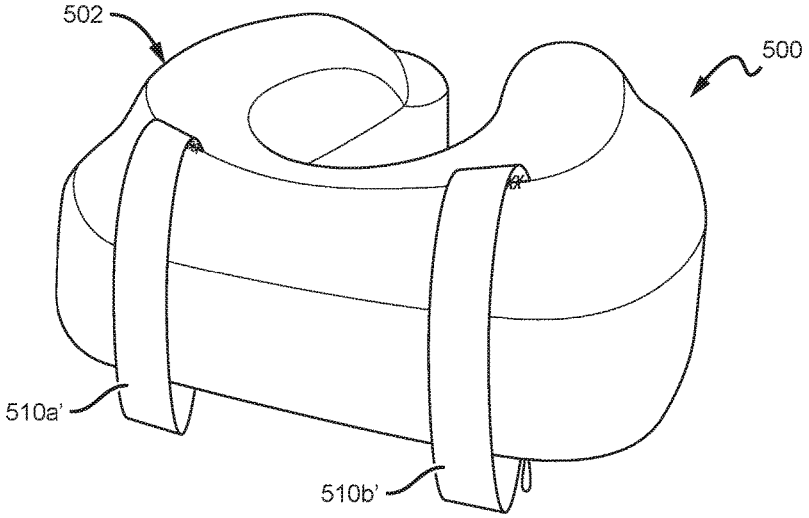
FIG. 43B
FIG. 44A
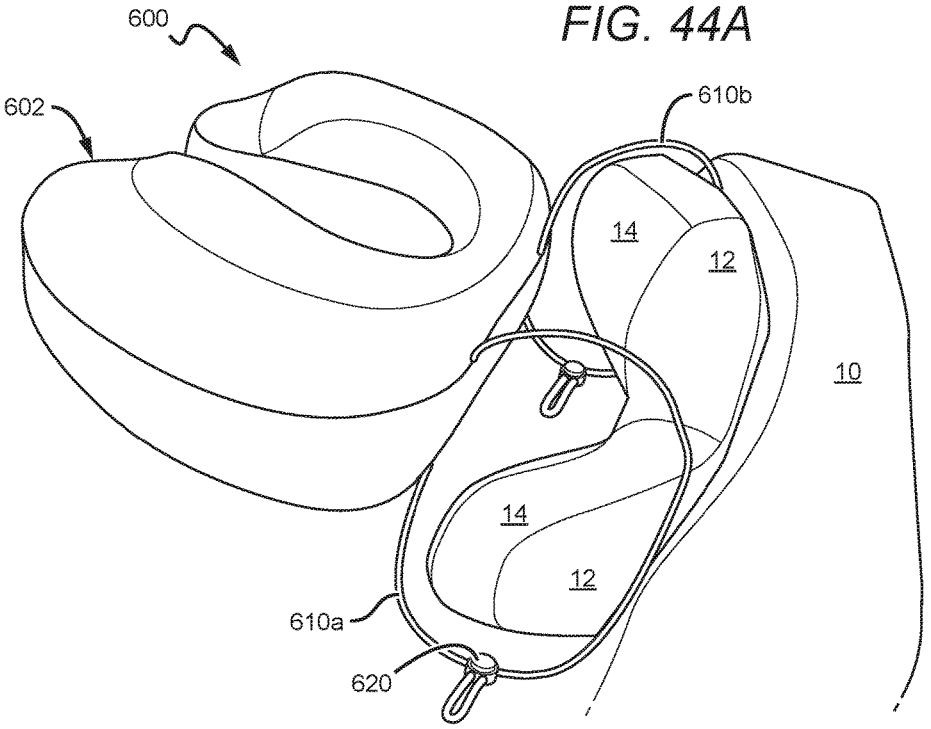

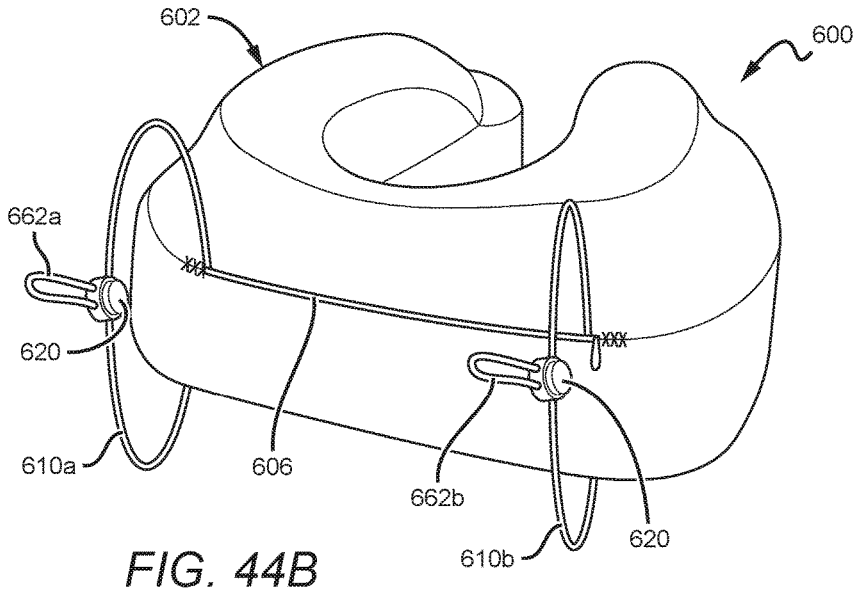
FIG. 44B
FIG. 45
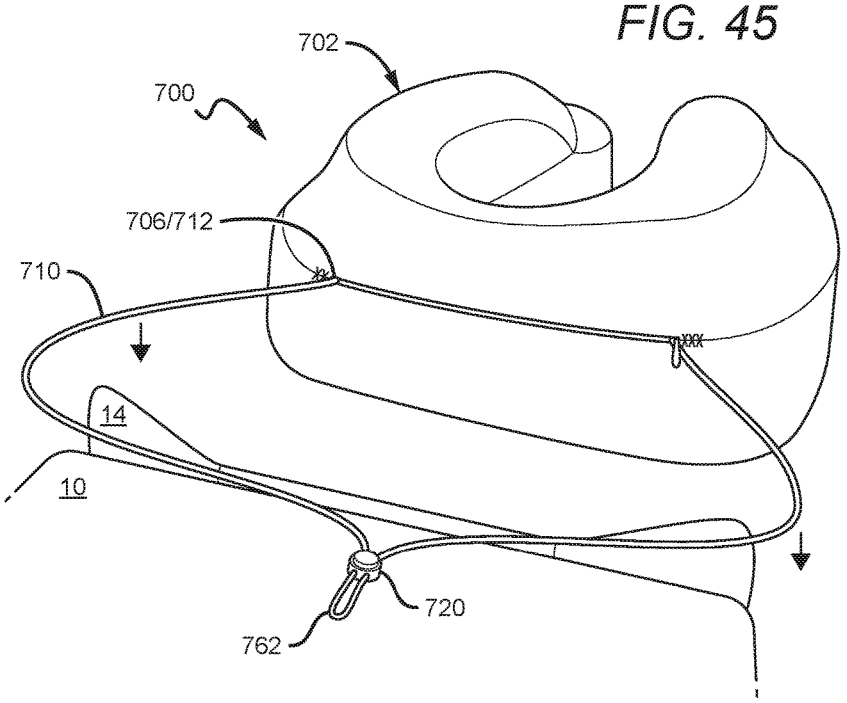

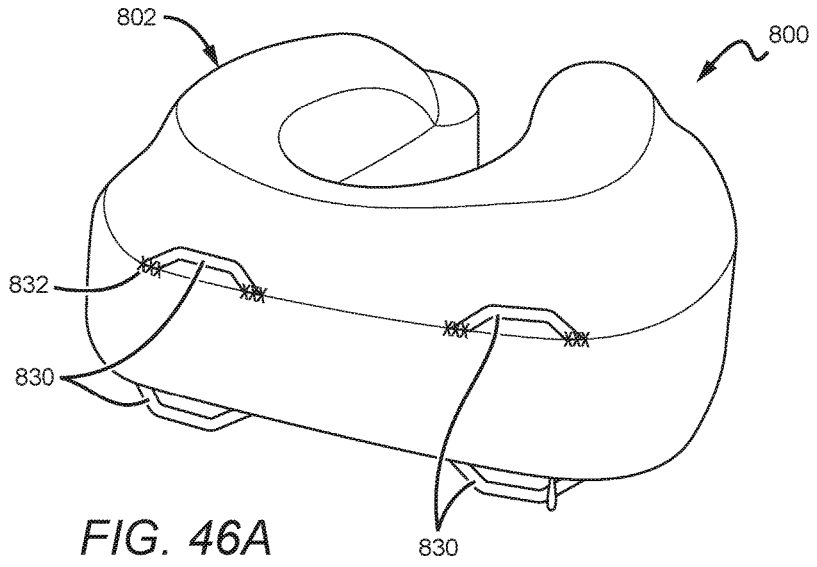
FIG. 46A
FIG. 46B
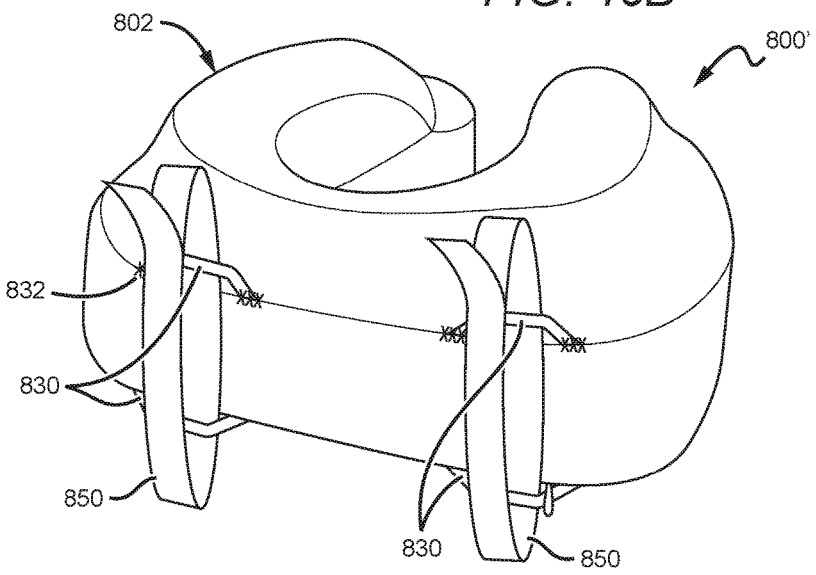

TRAVEL PILLOW WITH ANCHORING FEATURES

This application claims the priority benefit of U.S. Provisional Pat. App. No. 62/531,278 to Sternlight et al., filed on Jul. 11, 2017 and entitled "Travel Pillow with Anchoring Features"; of U.S. Provisional Pat. App. No. 62/571,785 to Sternlight et al., filed on Oct. 12, 2017 and entitled "Travel Pillow with Anchoring Features"; and of U.S. Provisional Pat. App. No. 62/574,366 to Sternlight et al., filed on Oct. 19, 2017 and entitled "Travel Pillow with Anchoring Features." Each of these applications is fully incorporated by reference herein in its entirety, including but not limited to its specification, claims, and figures.

BACKGROUND

Field

This disclosure relates generally to travel pillows and cushions, and more particularly to travel pillows and cushions including features for anchoring or attachment to a seat or headrest, and even more particularly to travel pillows and cushions including anchor mechanisms with bodies that loop around a portion of a headrest to secure the travel pillow or cushion to the headrest.

Description of the Related Art

Travel pillows are used by airplane travelers and others in order to provide support to a user's neck and head. Examples of travel pillows are described, for example, in commonly assigned U.S. Pat. No. 9,635,962 to Sternlight et al., which describes in some embodiments a pillow with base and raised cushions with mutually flush and substantially flat rear walls; PCT Pat. App. Pub. No. WO/2015/138654 to Wong et al.; and U.S. Pub. No. 2017/0086607 to Wong et al. Each of these applications is fully incorporated by reference herein in its entirety.

While many prior art travel pillows provide support for a user's head, they do not prevent the user's body from falling forward. In an effort to solve this problem, U.S. Pat. No. 9,414,691 to Blyberg describes devices for anchoring a travel pillow to a headrest, such as the headrest of an airplane seat, via a system of cords with rigid hooks. However, such a system is inconveniently unwieldy for travelling, and further requires looping of the cords around the travel pillow's legs in a manner that can be unstable. U.S. Pub. No. 2005/0179300 to O'Connor also describes a headrest system that can be attached to a headrest via a system that is similarly unwieldy. U.S. Pat. No. 6,435,617 to McNair describes a system with a strap for attaching a neck rest to a headrest, but the strap is on a swivel which can cause it to become loose and need readjustment, and the device includes bulky plates attached to the cushion by a bolt or pin in order to be operational. U.S. Pat. No. 5,544,378 to Chow and U.S. Pat. No. 7,938,491 to Montuore include belt-like straps which can be difficult and time-consuming to tighten.

Modern airplane seat headrests often include wings, which are designed in an attempt to provide side support to a user's head. In some instances, the headrest wings have an adjustable position, such that a user can rotate them inward toward his or her head to provide closer side support. One example of a seat 10 including a headrest 12 having wings 14 is shown as part of FIG. 42.

SUMMARY OF THE DISCLOSURE

The present disclosure is generally directed to travel pillows including features for anchoring to a seat or headrest, such as an airplane headrest including wings.

One embodiment of a travel pillow according to the present disclosure includes a body including a cover. The travel pillow further includes two anchor mechanisms each including an anchor mechanism body such as a strap. The anchor mechanism bodies are attached to the pillow body, such as to a cover and/or rear portion of the pillow body. The anchor mechanisms each further includes a loop or connection mechanism which is also be attached to the pillow body, such as to the cover and/or rear portion of the pillow body. Each of the anchor mechanism bodies can pass through, loop around, or otherwise connect to a respective one of the loops or connection mechanisms, and then loop around a seatback headrest wing. The anchor mechanism can then connect to itself using fasteners such as hook-and-loop fasteners, such as that provided by Velcro®. In alternative configurations, each anchor mechanism body may connect to another anchor mechanism body instead of to itself, and/or the anchor mechanism bodies may connect to themselves without first passing through a loop or connection mechanism.

One embodiment of a travel pillow cover according to the present disclosure includes a cover body and two vertically oriented anchor mechanism bodies each attached to the cover body at a respective static attachment point. Each of the anchor mechanism bodies is configured to pass around a seatback headrest wing before attaching to itself or to the cover body.

Another embodiment of a travel pillow according to the present disclosure includes a travel pillow body having a memory foam core and a cover over the memory foam core. The travel pillow also includes first and second anchor mechanisms attached at least partially to the cover, the anchor mechanisms each comprising an anchor mechanism body attached to the cover, as well as a loop attached to the cover. Each of the anchor mechanism bodies is configured to pass through a respective one of the loops and reattach to itself so as to itself form a closed loop. The first and second anchor mechanism bodies are angled at least slightly outward and away from one another, as opposed to being parallel and directly rearward facing.

Another embodiment of a travel pillow according to the present disclosure includes a travel pillow body and two vertically oriented anchor mechanism bodies attached to a rear of said body, each of said anchor mechanism bodies configured to form a loop for looping around a seatback headrest wing.

Another embodiment of a travel pillow according to the present disclosure includes a body comprising a cover, the cover comprising four loops, and further includes two vertically oriented anchor mechanism bodies. Each of the anchor mechanism bodies is configured to pass through two of the loops.

Another embodiment of a travel pillow according to the present disclosure includes a memory foam core and a cover over the memory foam core. The cover can include first and second regions, with the second region made of a composite material comprising fibers.

These and other further features and advantages of the disclosure would be apparent to those skilled in the art from the following detailed description, taken together with the accompanying drawings, in which:

BRIEF DESCRIPTION OF THE DRAWINGS

FIGS. 43A and 43B are perspective views of yet another embodiment of a travel pillow according to the present disclosure.

FIGS. 44A and 44B are perspective views of yet another embodiment of a travel pillow according to the present disclosure.

FIG. 45 is a perspective view of yet another embodiment of a travel pillow according to the present disclosure.

FIGS. 46A and 46B are perspective views of yet another embodiment of a travel pillow according to the present disclosure.

DETAILED DESCRIPTION OF THE INVENTION

The present disclosure describes travel pillows that include anchoring functionality. The anchoring functionality can connect the travel pillow to a seatback headrest so as to prevent or make less likely a user's head falling forward, away from the headrest, such as via the user's body falling forward. The anchoring functionality can be provided by, for example, one or more anchoring mechanisms attached to the rear of the pillow body or elsewhere. These anchoring mechanisms can include bodies that loop around headrest wings to secure the pillow to the headrest. The anchoring mechanisms can be substantially vertically oriented.

The present disclosure is described herein with reference to certain embodiments, but it is understood that the disclosure may be embodied in many different forms and should not be construed as limited to the embodiments set forth herein. The devices and elements herein may have different shapes and sizes beyond those shown. It is also understood that when a feature or element, such as a layer, region, case, cover, frame, or otherwise may be referred to as being "on" another element, it can be directly on the other element or intervening elements may also be present. Furthermore, relative terms such as "inner," "outer," "upper," "above," "lower," "beneath," and "below," and similar terms may be used herein to describe a relationship of one element to another. It is understood that these terms are intended to encompass different orientations of the device in addition to the orientation depicted in the figures.

Although the terms first, second, etc. may be used herein to describe various, e.g., elements, components, regions, layers and/or sections, these elements, components, regions, layers and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present disclosure.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. When the word "each" is used to refer to an element, it does not necessarily imply a plurality of the elements, but can also mean a singular element.

Figure 17A:
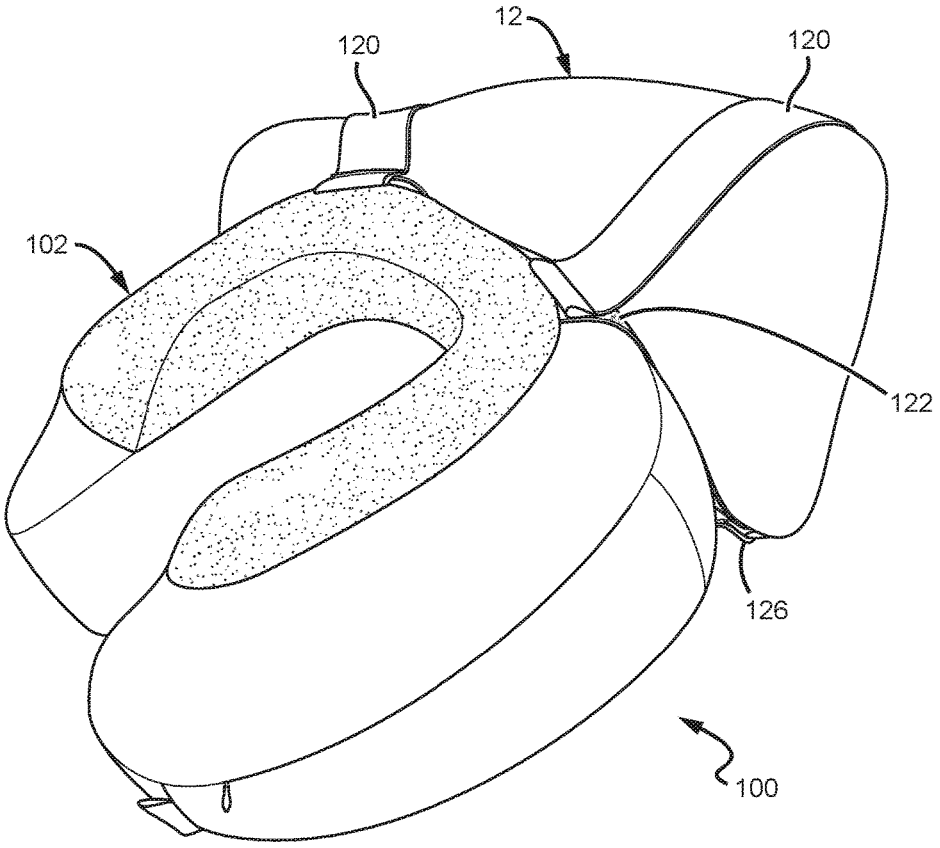
FIGS. 17A and 17B are front perspective views of the travel pillow shown in FIG. 1, shown in use with a headrest, in first and second configurations, respectively.
Figure 17B:
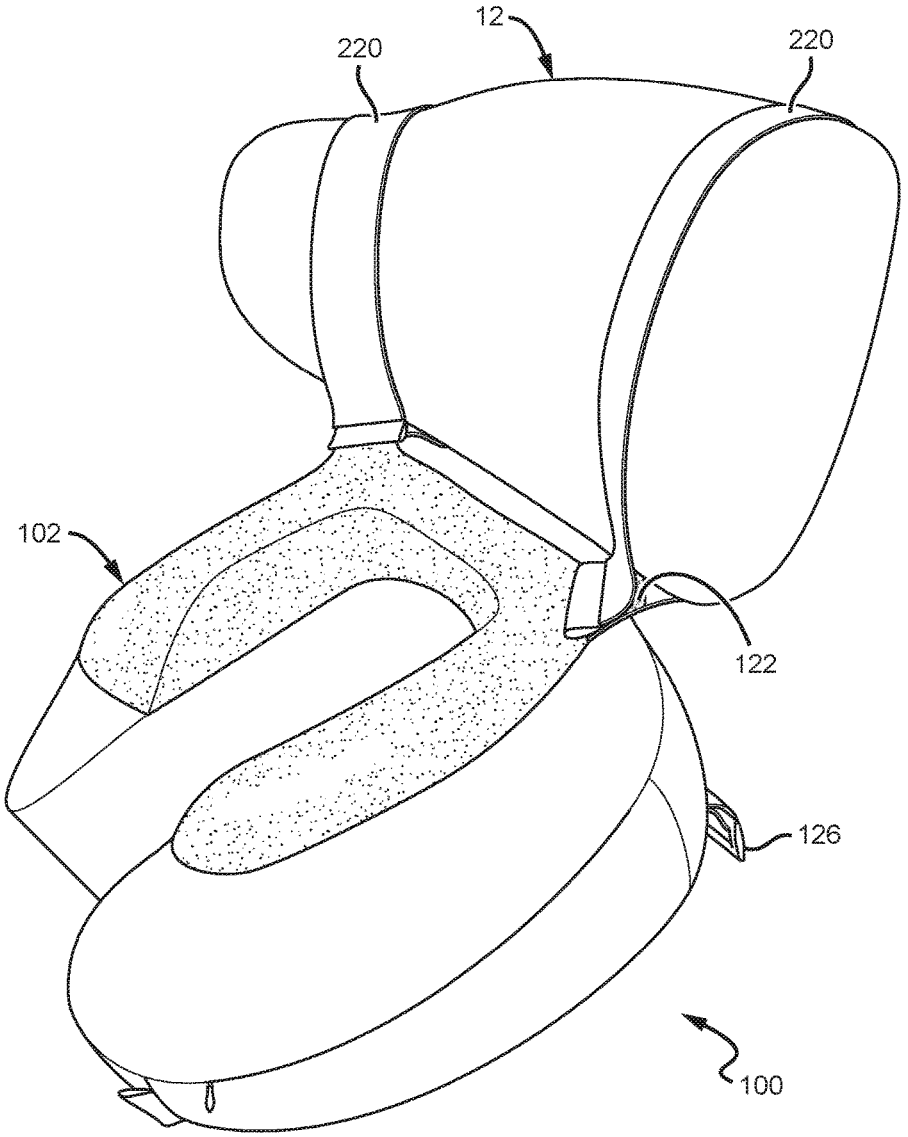
Figure 18:
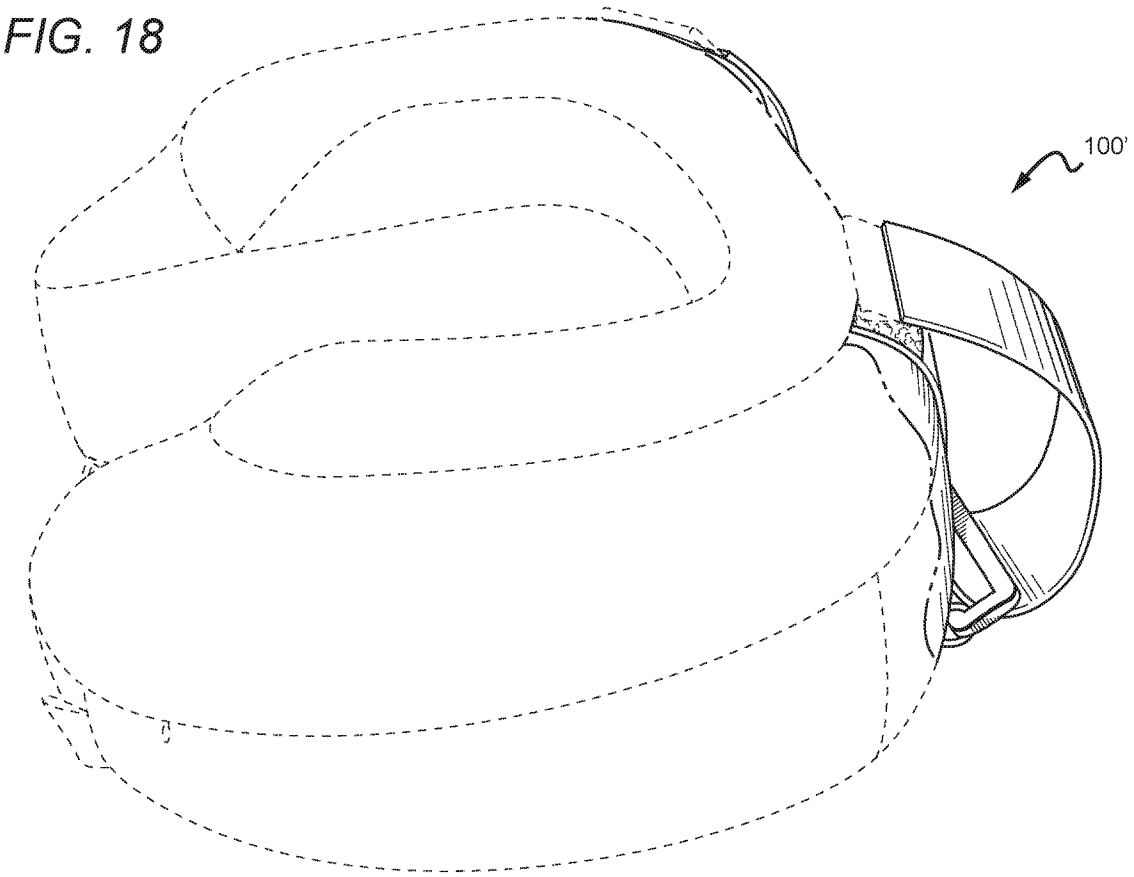
FIGS. 18-25 are front perspective, rear perspective, front, rear, left side, right side, top, and bottom views, respectively, showing a specific combination of elements of the travel pillow shown in FIG. 1.
Figure 19:
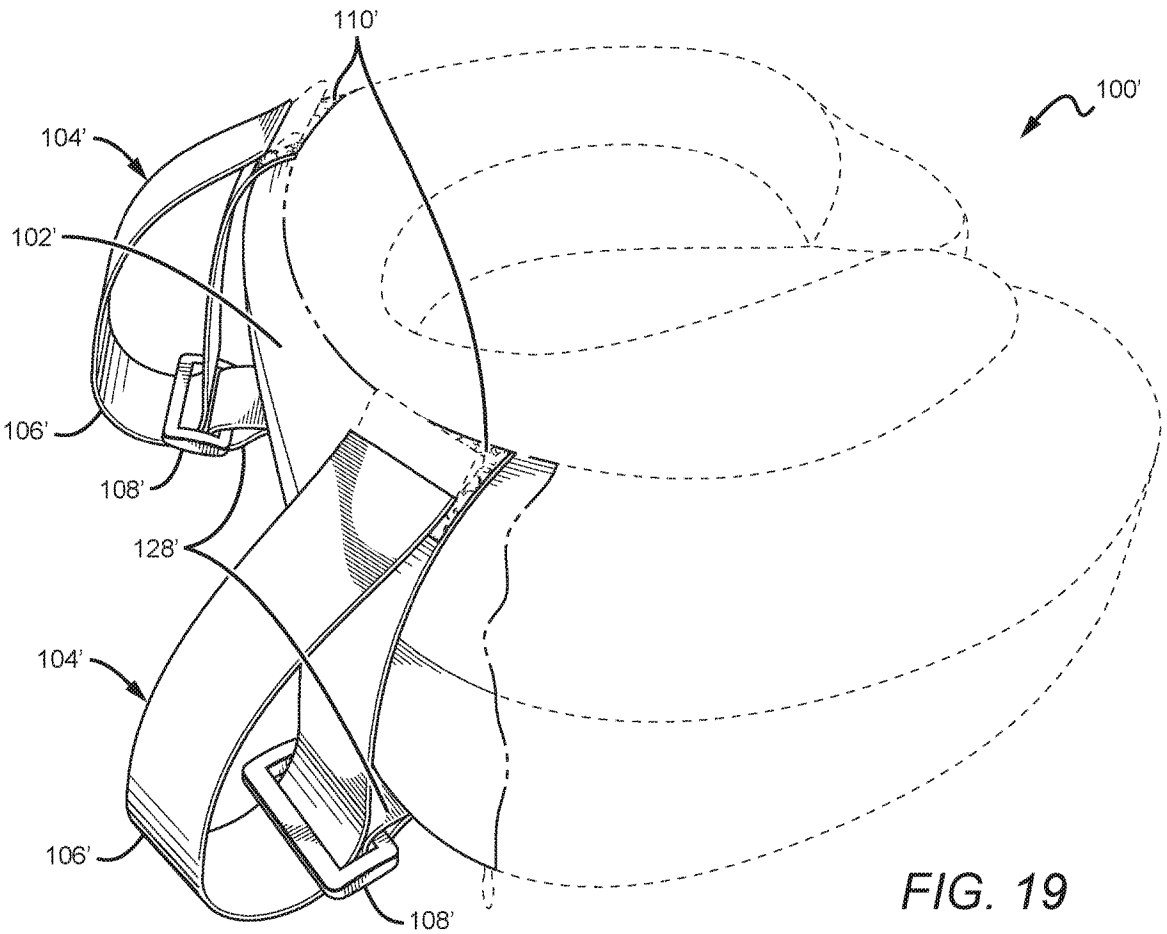
Figure 20:
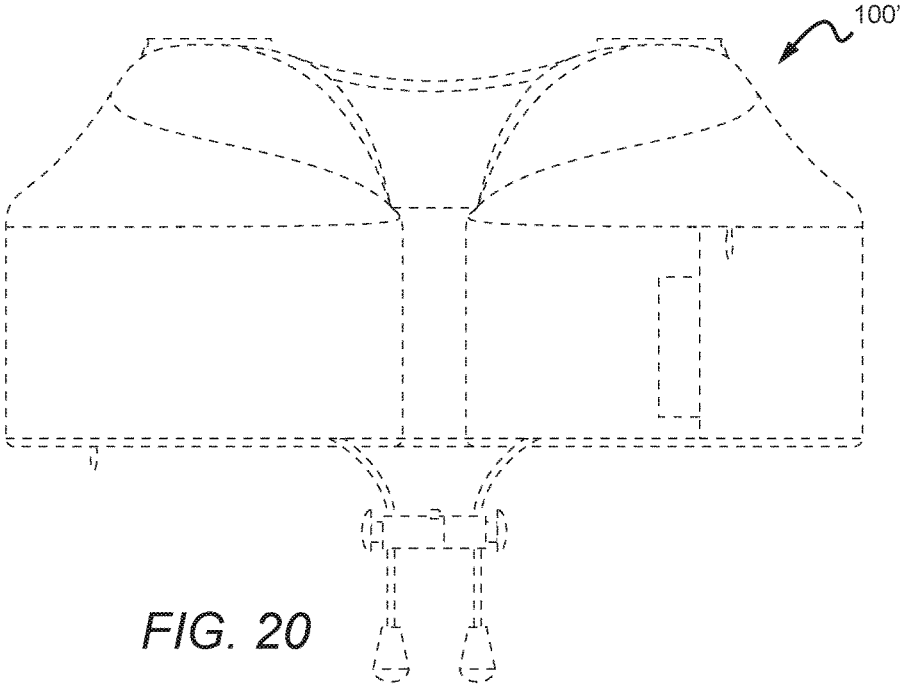
Figure 21:
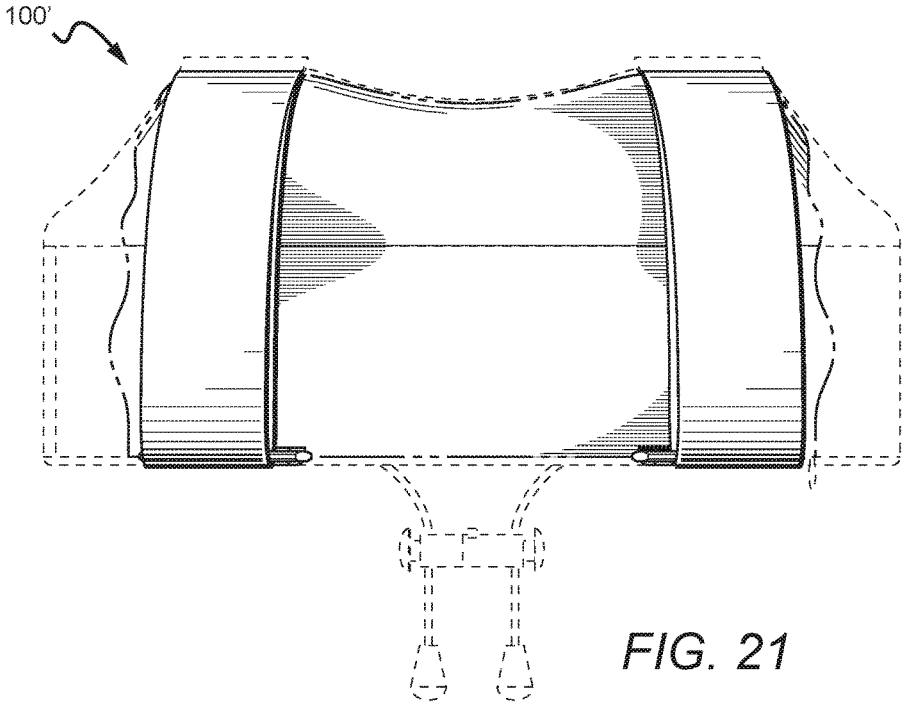
Figure 22:
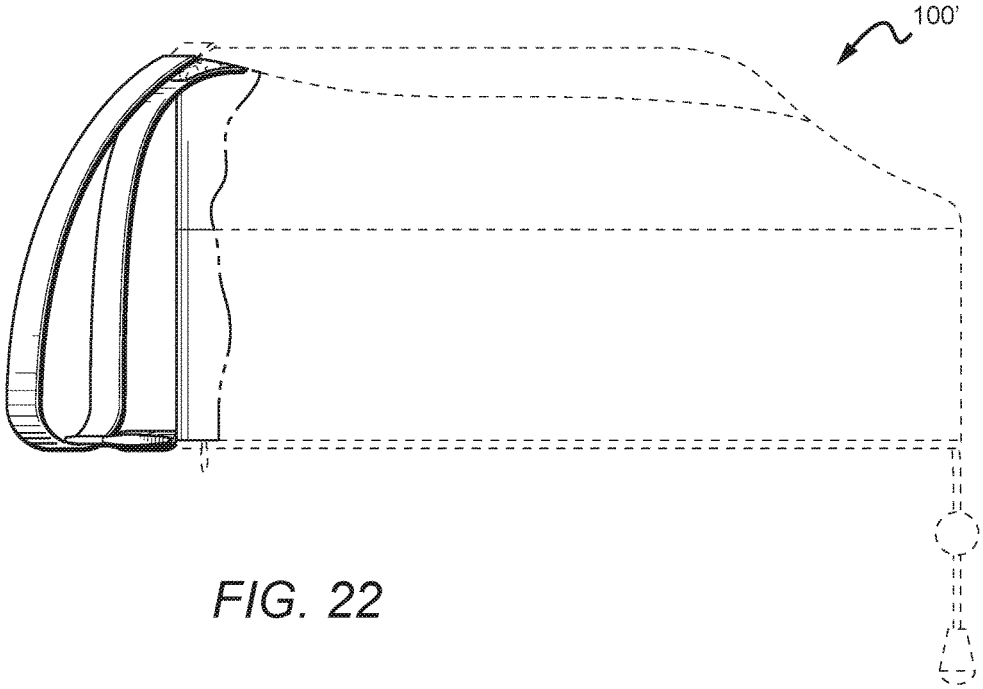
Figure 23:
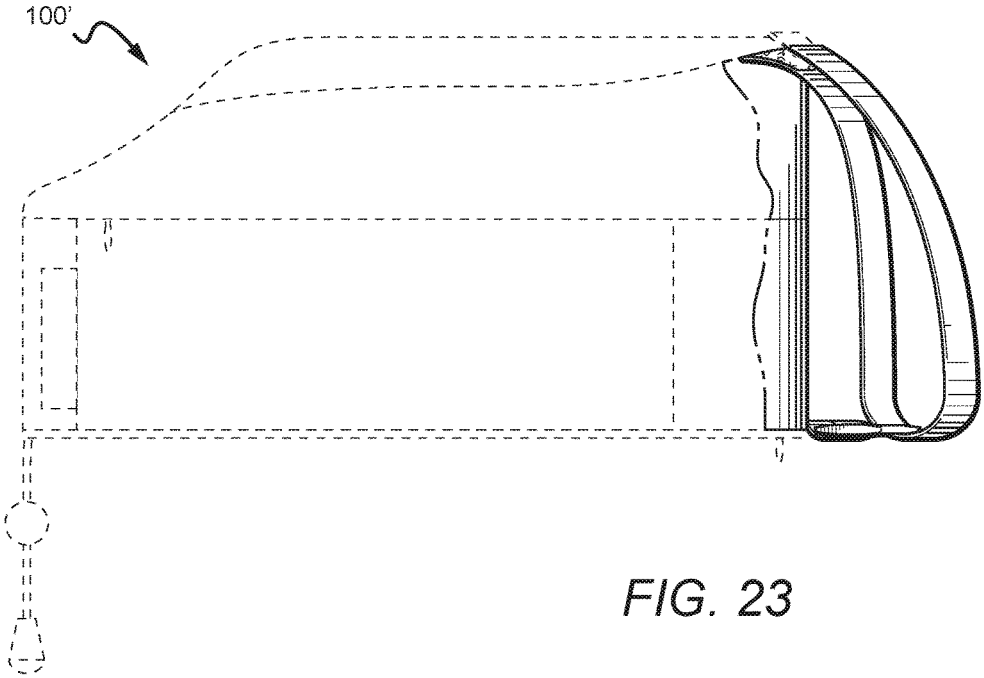
Figure 24:
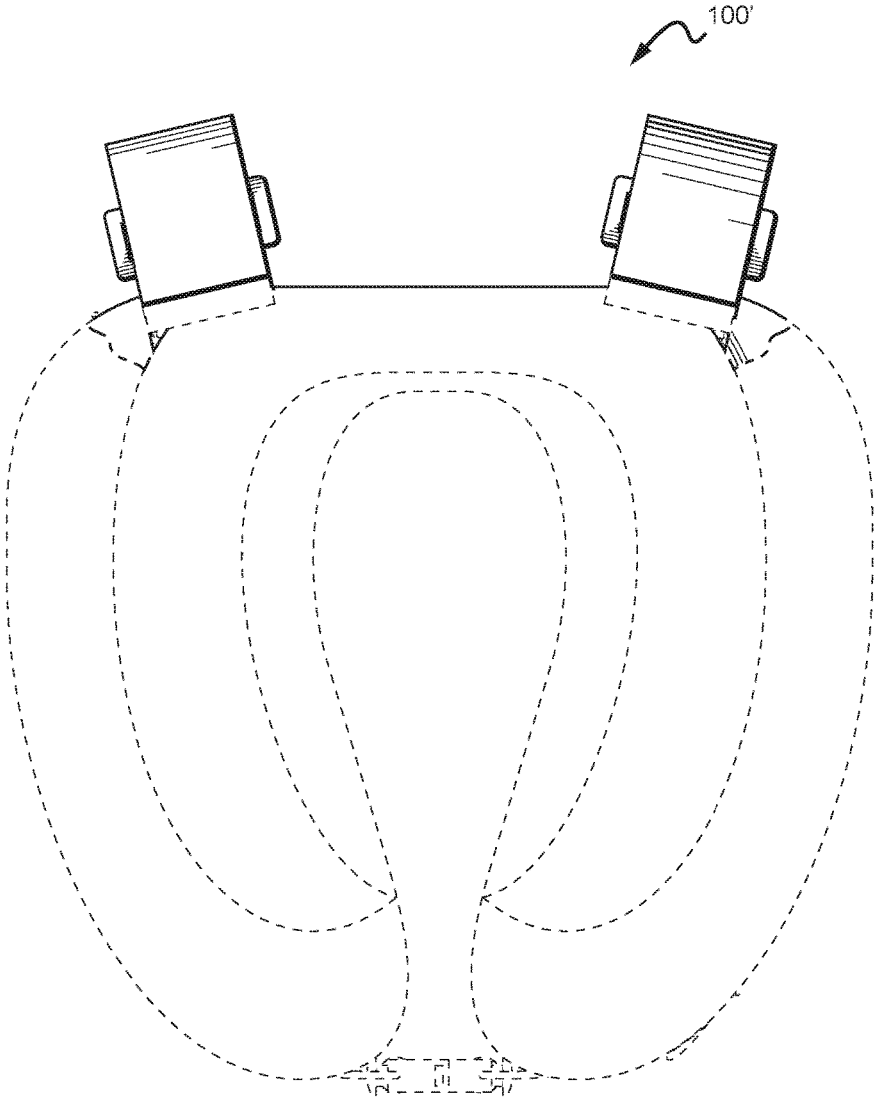
Figure 25:
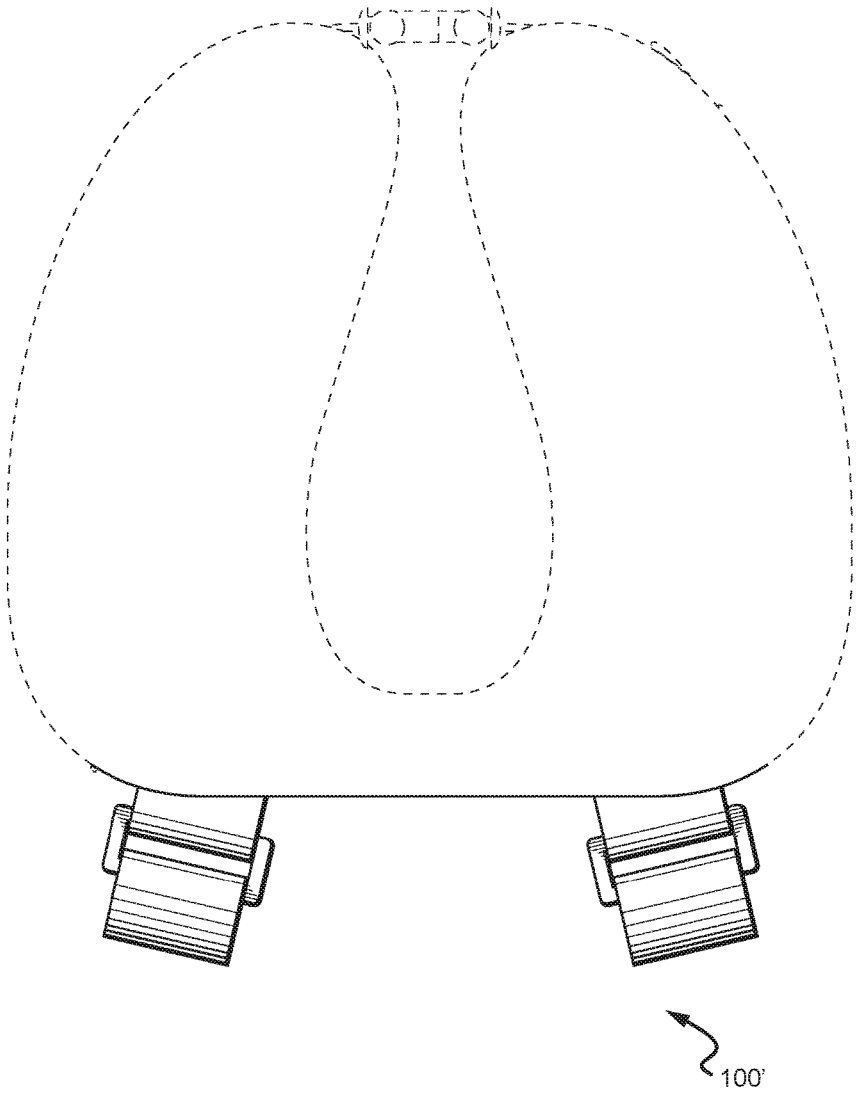
Figure 26:
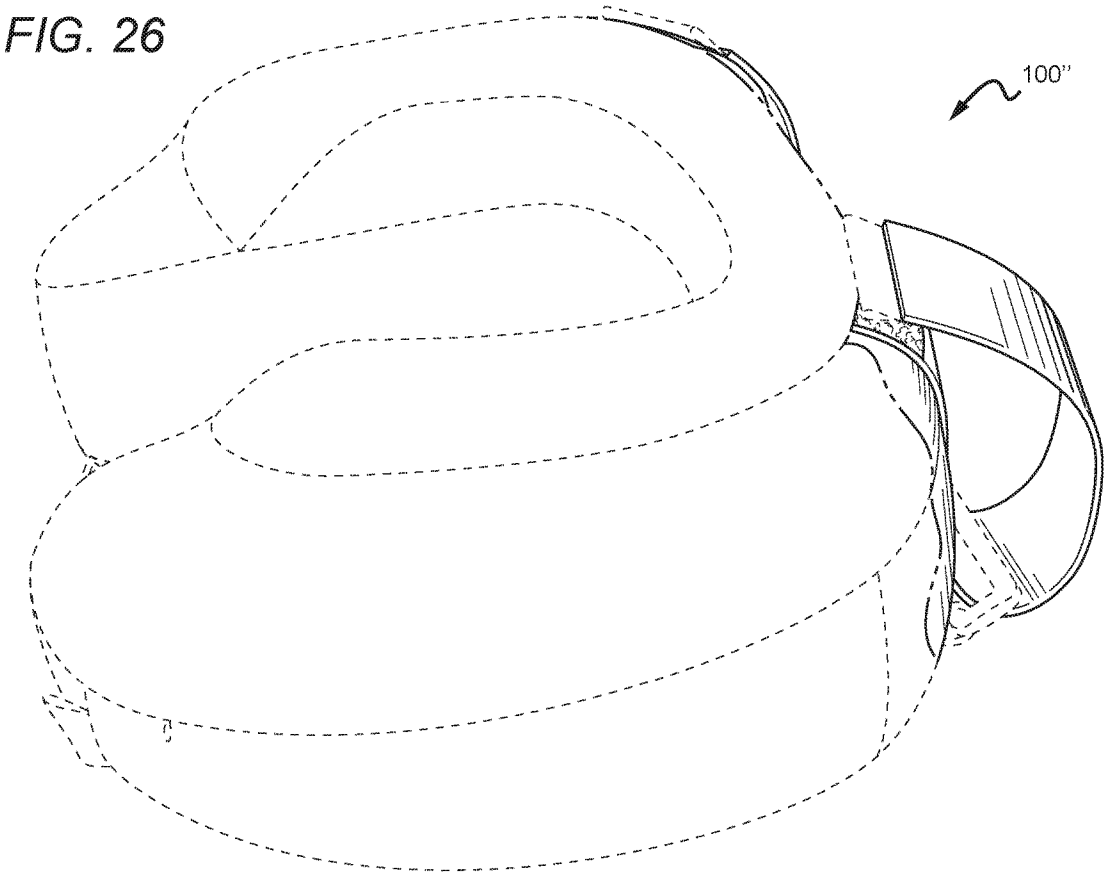
FIGS. 26-33 are front perspective, rear perspective, front, rear, left side, right side, top, and bottom views, respectively, showing another specific combination of elements of the travel pillow shown in FIG. 1.
Figure 27:
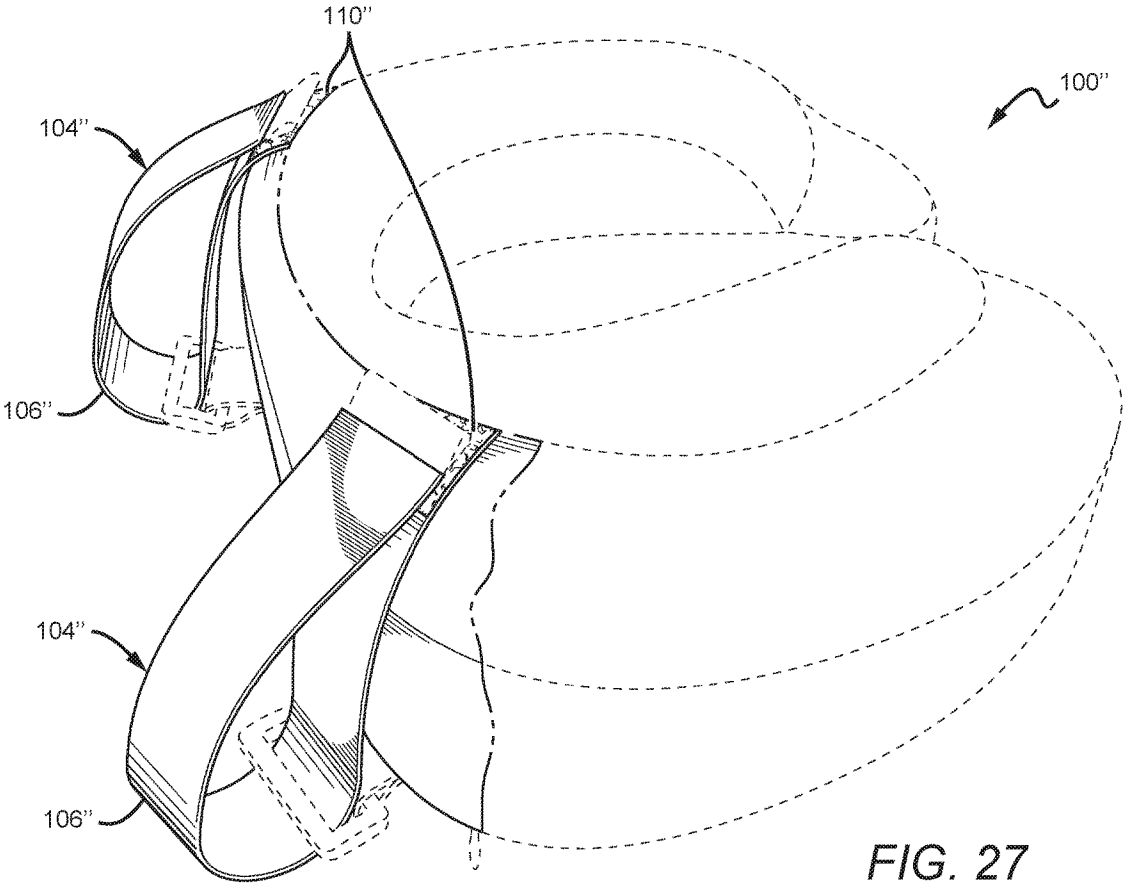
Figure 28:
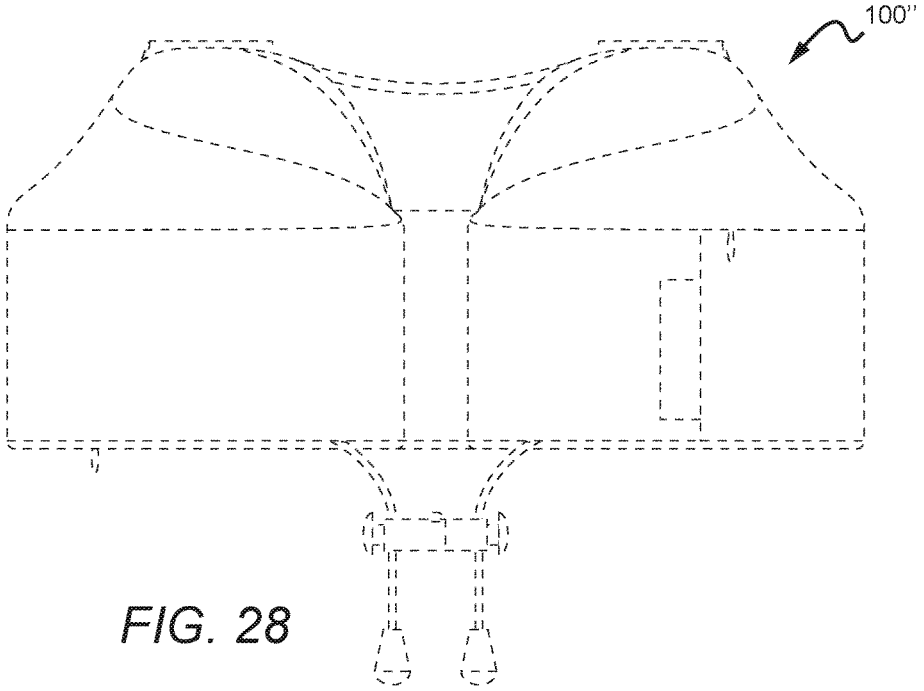
Figure 29:
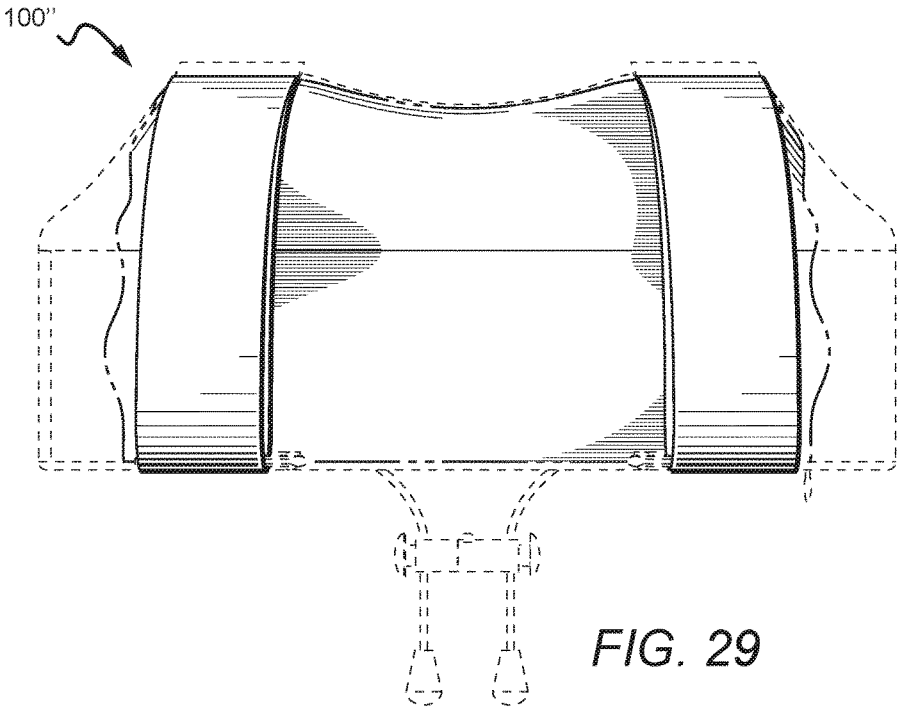
Figure 30:
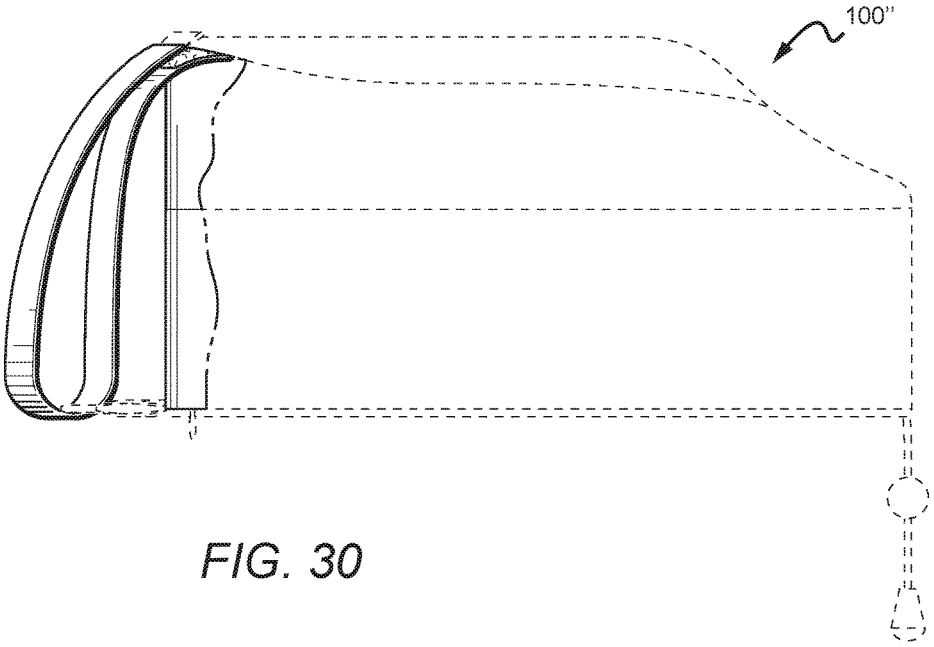
Figure 31:
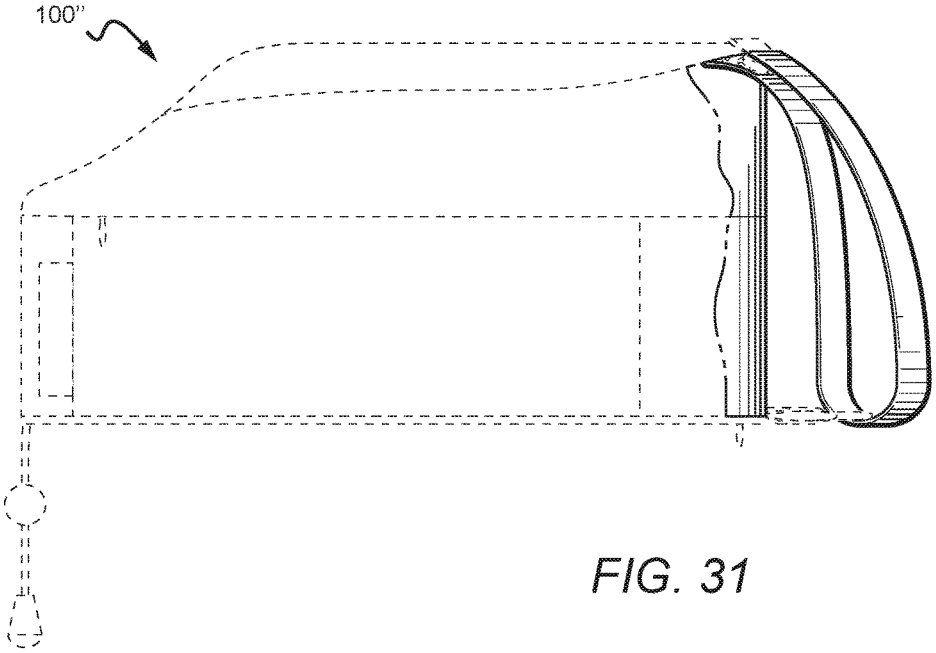
Figure 32:
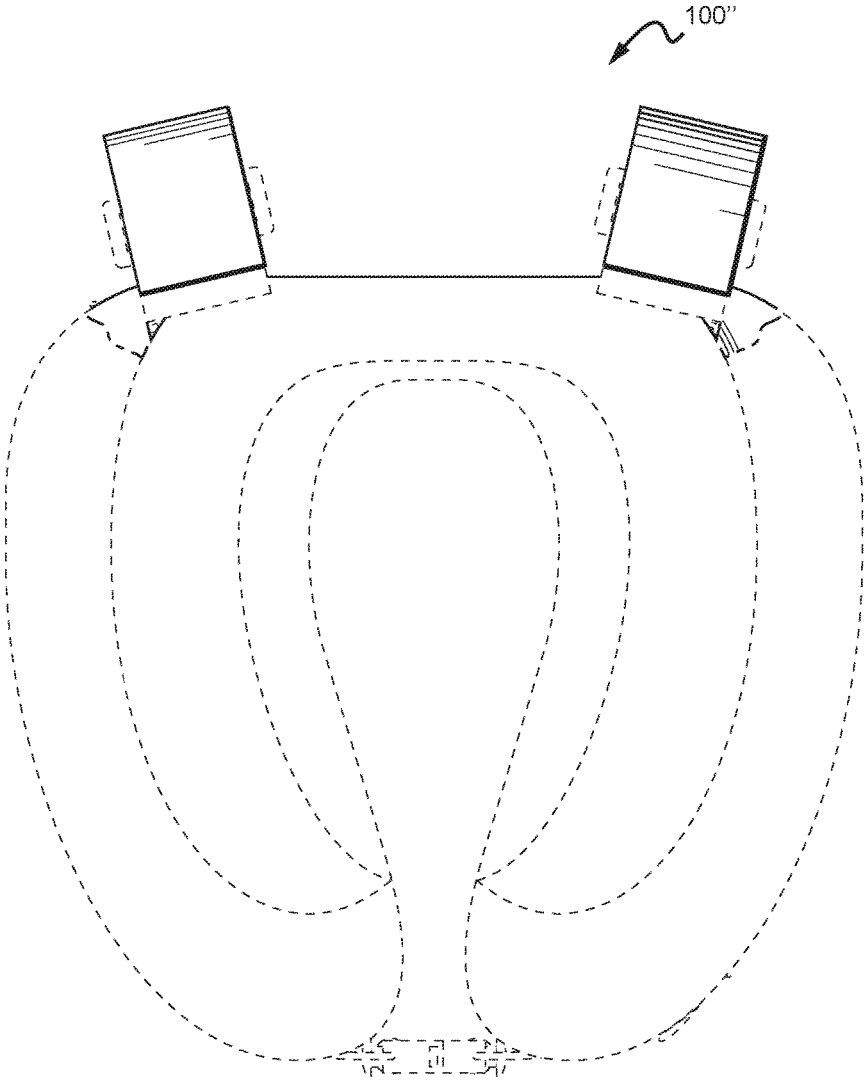
Figure 33:
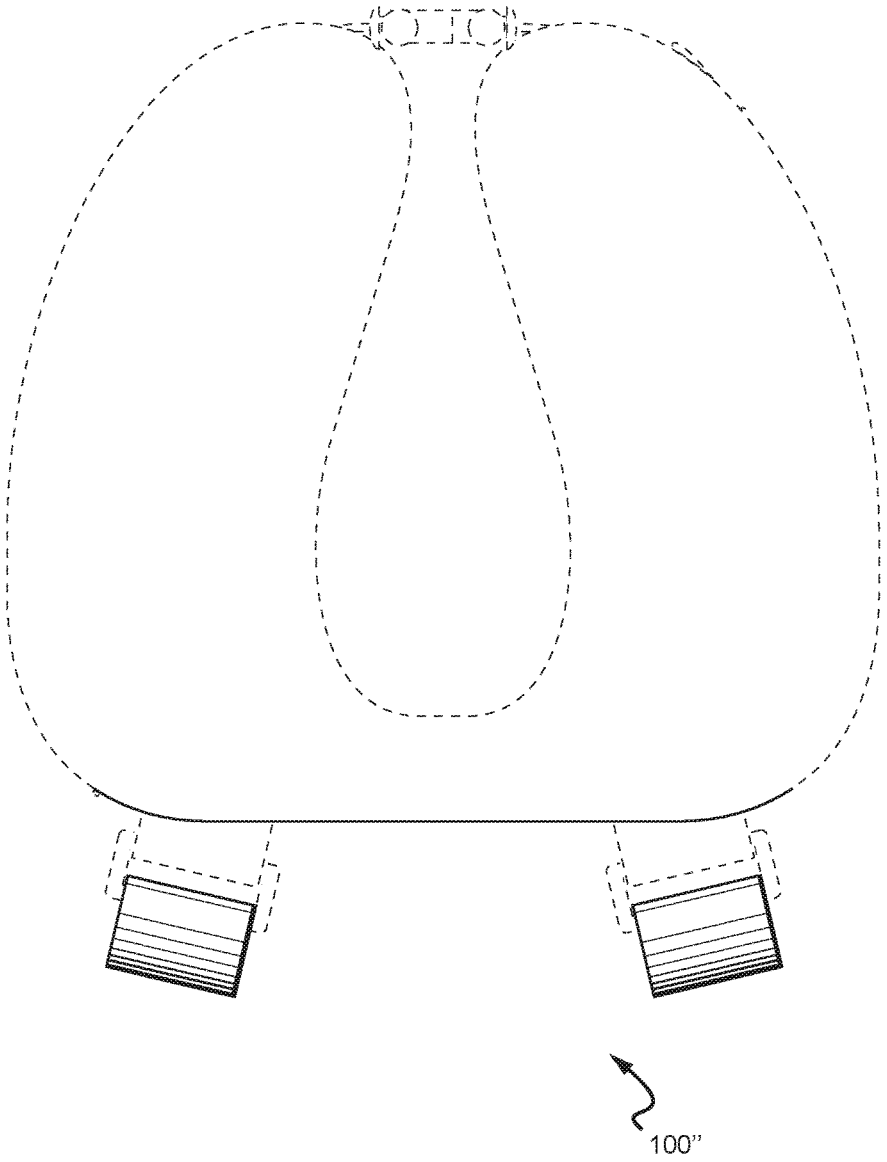
Figure 34:
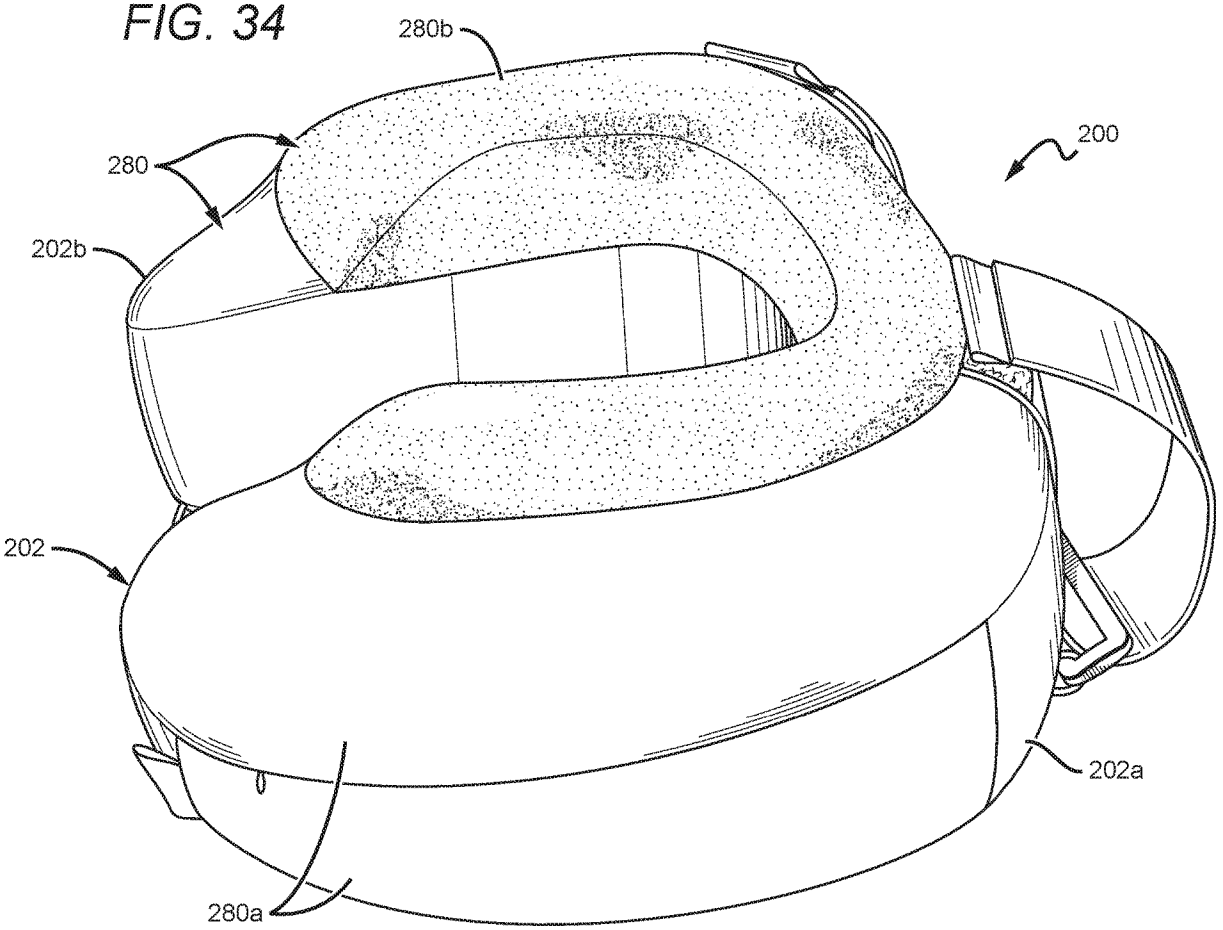
FIGS. 34-41 are front perspective, rear perspective, front, rear, left side, right side, top, and bottom views of another embodiment of a travel pillow according to the present disclosure.
Figure 35:
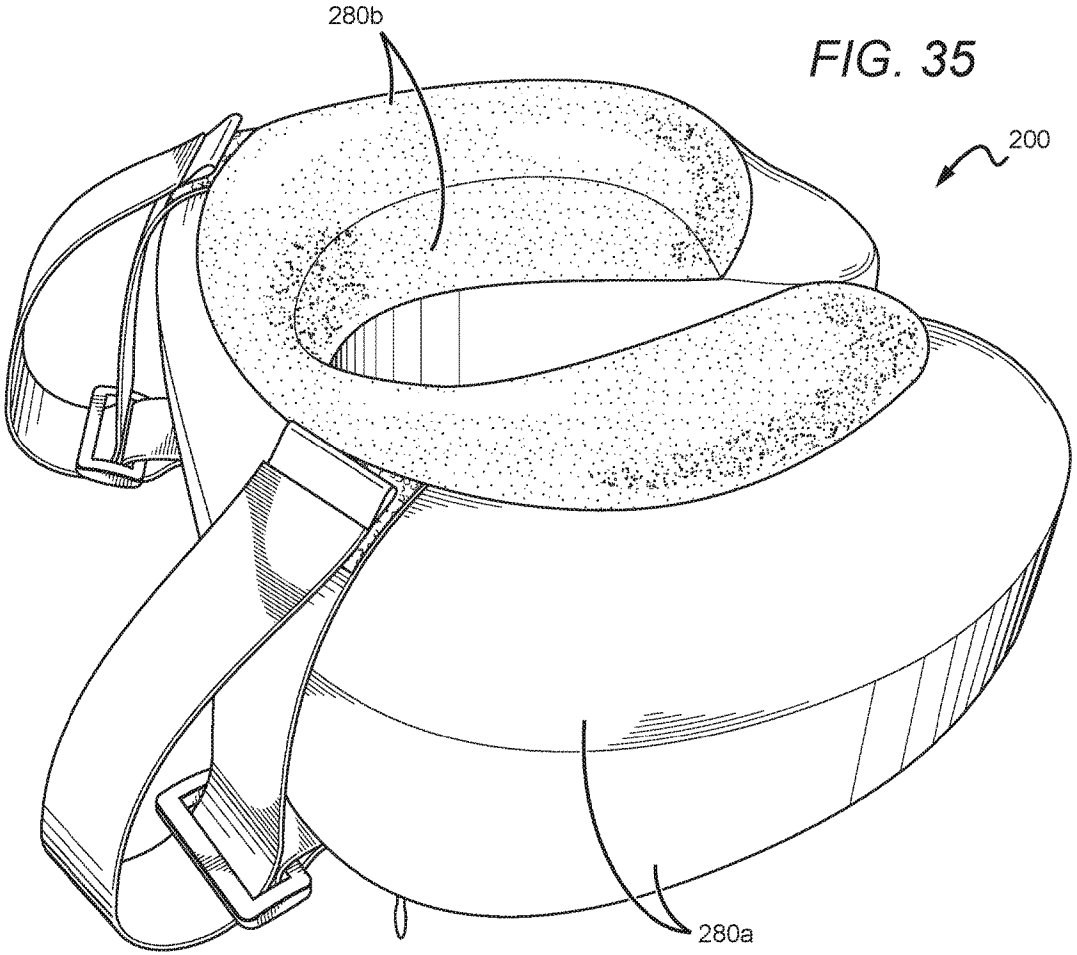
Figure 36:
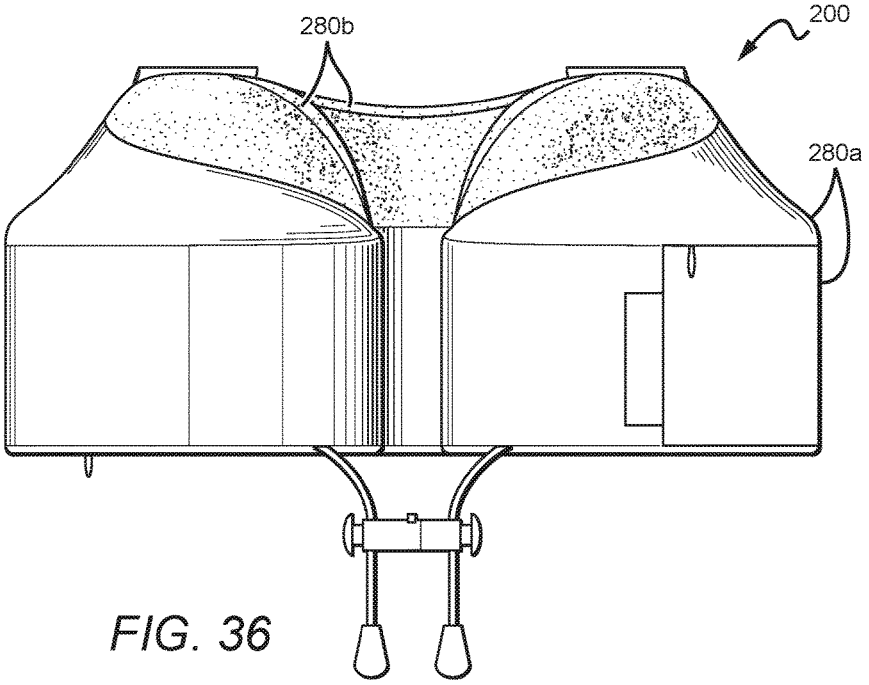
Figure 37:
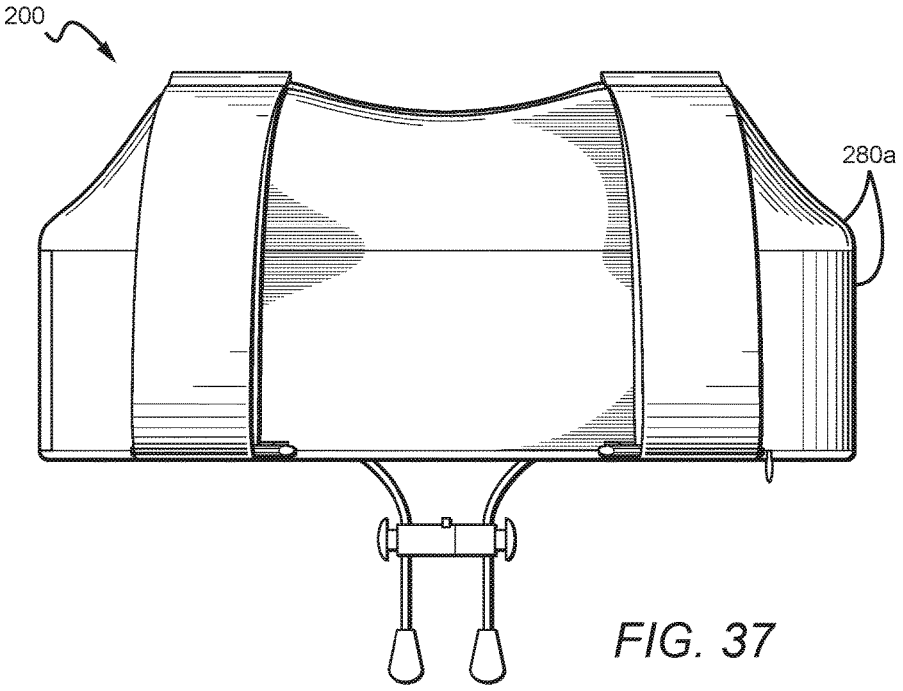
Figure 38:
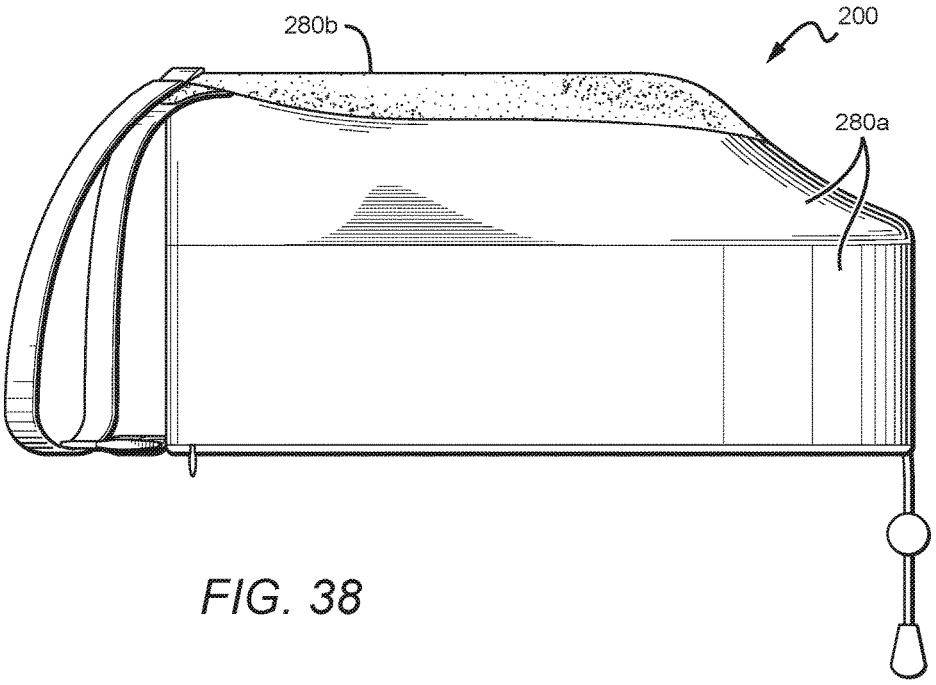
Figure 39:
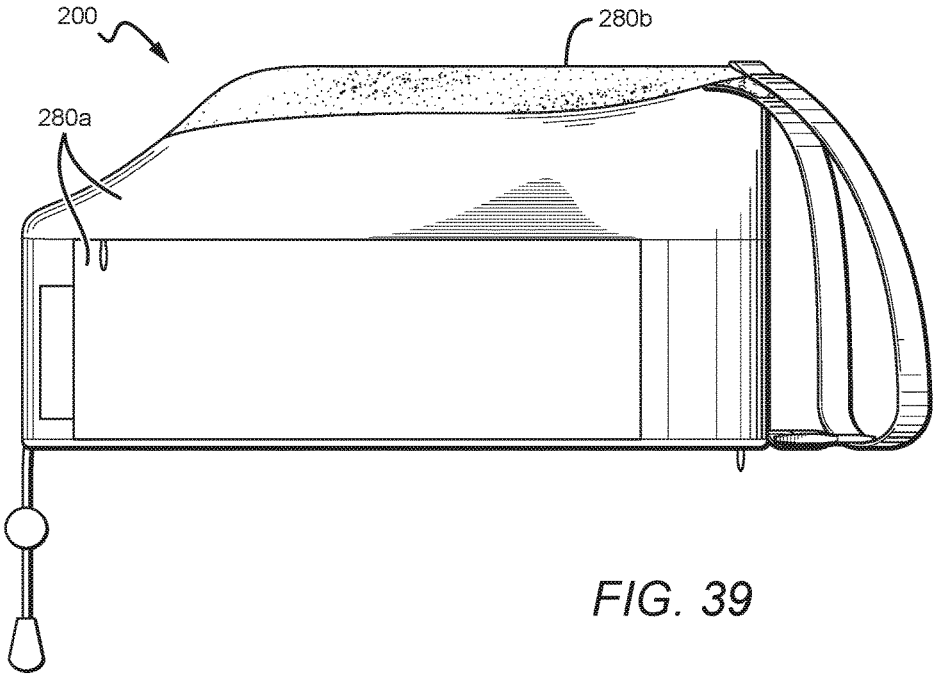
Figure 40:
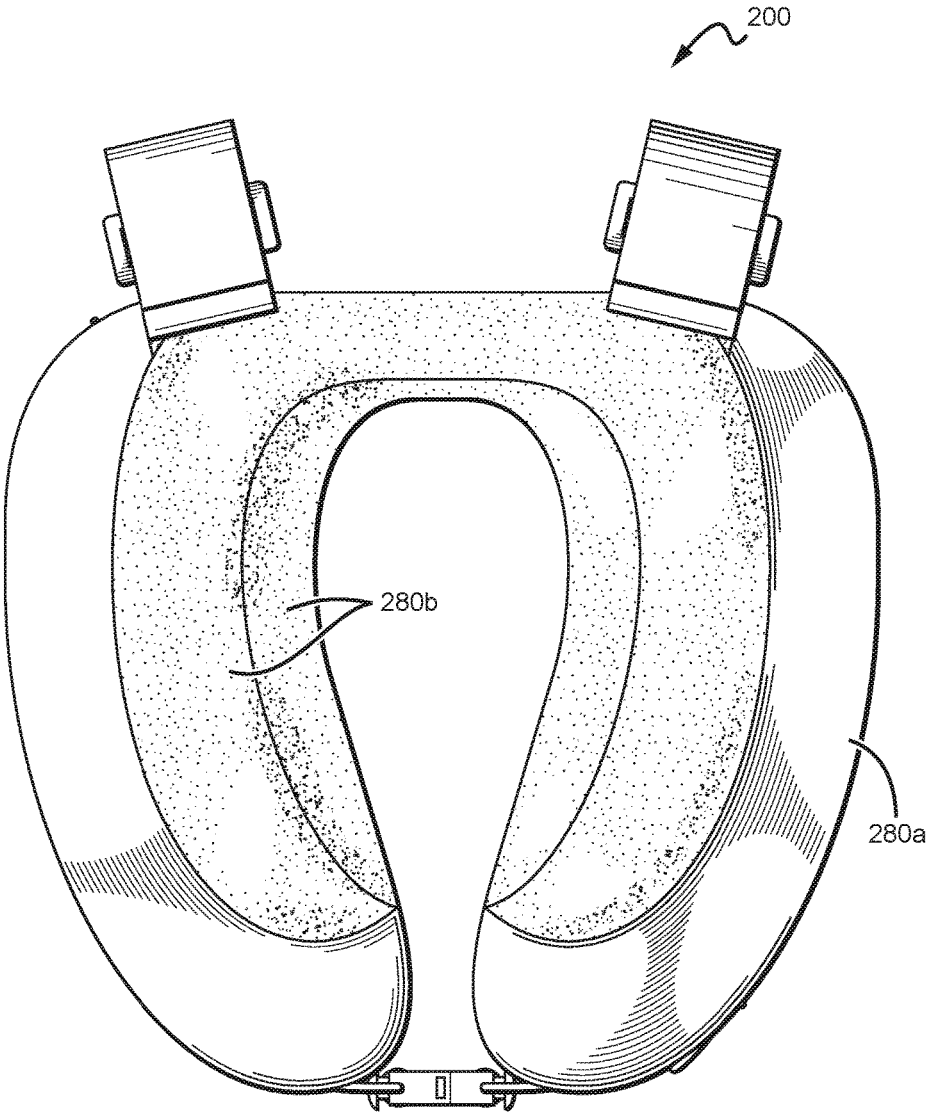
Figure 41:
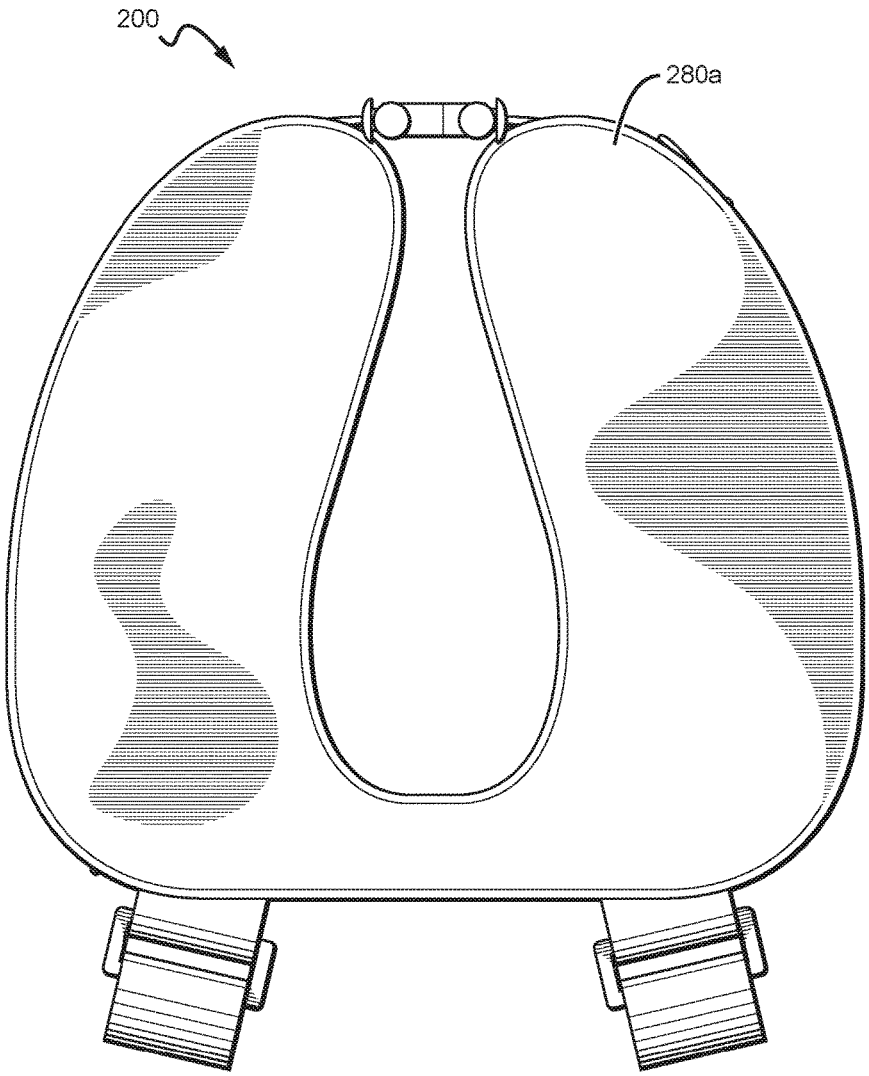

FIGS. 1-8 show views of a pillow 100 according to the present disclosure, with FIGS. 9-16 showing the pillow 100 in a second configuration with opened anchor mechanisms, and FIGS. 17A and 17B showing the pillow 100 attached to a headrest 12. The pillow 100 comprises a travel pillow body 102 that can include a cover 103 that partially or fully covers a core therein, such as a memory foam core. In some embodiments, the travel pillow body 102 does not have a cover 103. The shapes shown by the figures in the present disclosure can be the shape of a body with the cover, or without the cover (e.g., the shape of a memory foam core). The travel pillow body 102 may include many features described in U.S. Pat. No. 9,635,962 to Sternlight, such as a substantially flat rear wall 104, though it is understood that embodiments of the present disclosure can include many different styles of travel pillow body, such as those described in PCT Pat. App. Pub. No. WO/2015/138654 to Wong et al. and U.S. Pub. No. 2017/0086607 to Wong et al. The travel pillow body 102 can also include mechanisms for bringing the legs 106 together or nearer one another, such as two drawstring halves 140 and a fastener such as those described in U.S. Pat. No. 9,635,962 or U.S. Pub. No. 2017/0086607 to Wong et al., and such as the cinch mechanism 142 shown in FIG. 3 and more fully described below.

Figure 1:
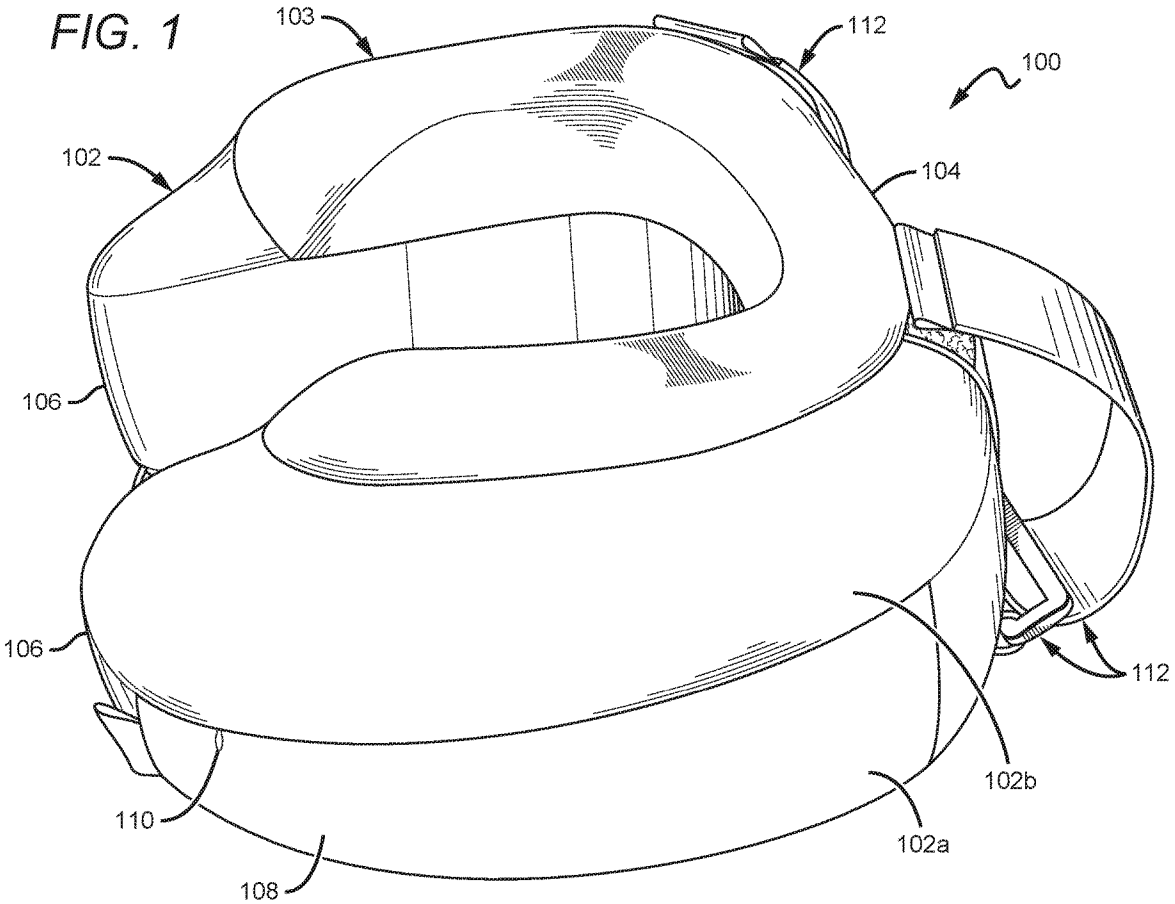
FIG. 1 is a front perspective view of one embodiment of a travel pillow according to the present disclosure.
Figure 2:
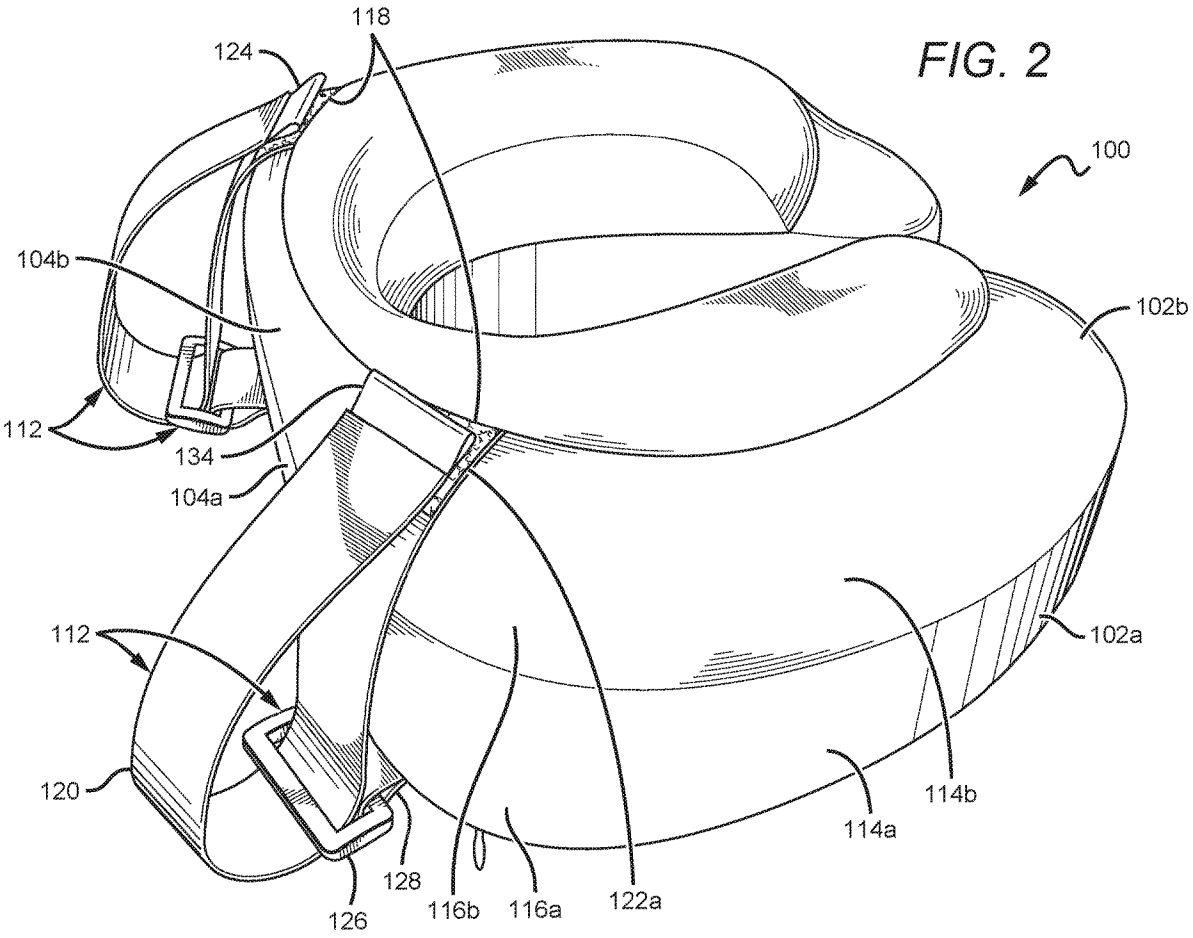
FIG. 2 is a rear perspective view of the travel pillow shown in FIG. 1.

FIG. 2 shows a rear perspective view of the pillow 100. The pillow 100 can include base and raised portions or cushions 102*a*,102*b* (referred to herein as "portions" for simplicity). The base portion 102*a* and raised portion 102*b* can include base and raised rear walls 104*a*,104*b*, with the substantially flat rear wall of the pillow 104 being formed by part or all of one or both of the base and raised rear walls 104*a*,104*b*. In one embodiment, the base and raised rear walls 104*a*,104*b* are mutually flush and combine to form the substantially flat rear wall 104 of the pillow body 102. The pillow body 102 can include base and raised side walls 114*a*,114*b*. In some embodiments, the pillow body 102 can also include base and raised curved transition walls 116*a*, 116*b* between the base and raised side walls 114*a*,114*b* and the base and raised rear walls 104*a*,104*b*. It is understood that while the above discusses base and raised portions of a pillow body, pillow bodies without distinct base and raised portions are possible, including but not limited to pillow bodies that include rear, side, and curved transition walls.

The pillow 100 includes two anchor mechanisms 112 which can serve to anchor the pillow 100 to a headrest, such as to headrest wings. The anchor mechanisms 112 can include anchor mechanism bodies 120. Anchor mechanisms 112 according to the present disclosure can include elongated anchor mechanism bodies such as the anchor mechanism bodies 120. For example, the anchor mechanism bodies can be 1" to 24" long, or 2" to 20" long, or 6" to 16" long, or 8" to 14" long, or about 11" long. Anchor mechanism bodies 120 according to the present disclosure can be, for example, ¼" to 4" wide, or ½" to 3" wide, or 1" to 2" wide, or about 1.5" wide. The anchor mechanism bodies 120 can be made of many different materials and take many different shapes. The anchor mechanism bodies 120 can be, for example, straps (as shown), cords, strings, ropes, or other flexible, rigid, or non-rigid devices as known in the art. The anchor mechanism bodies 120 can be elastic or inelastic, and can be cloth, cord, string, rope, nylon, poly cord, rubber, polyester, parachute cord, webbing, or other devices and materials as known in the art. In embodiments where the anchor mechanism bodies 120 are elastic, they can self-tighten around, for example, a portion of a headrest, to better secure the travel pillow 100 to the headrest.

Figure 7:
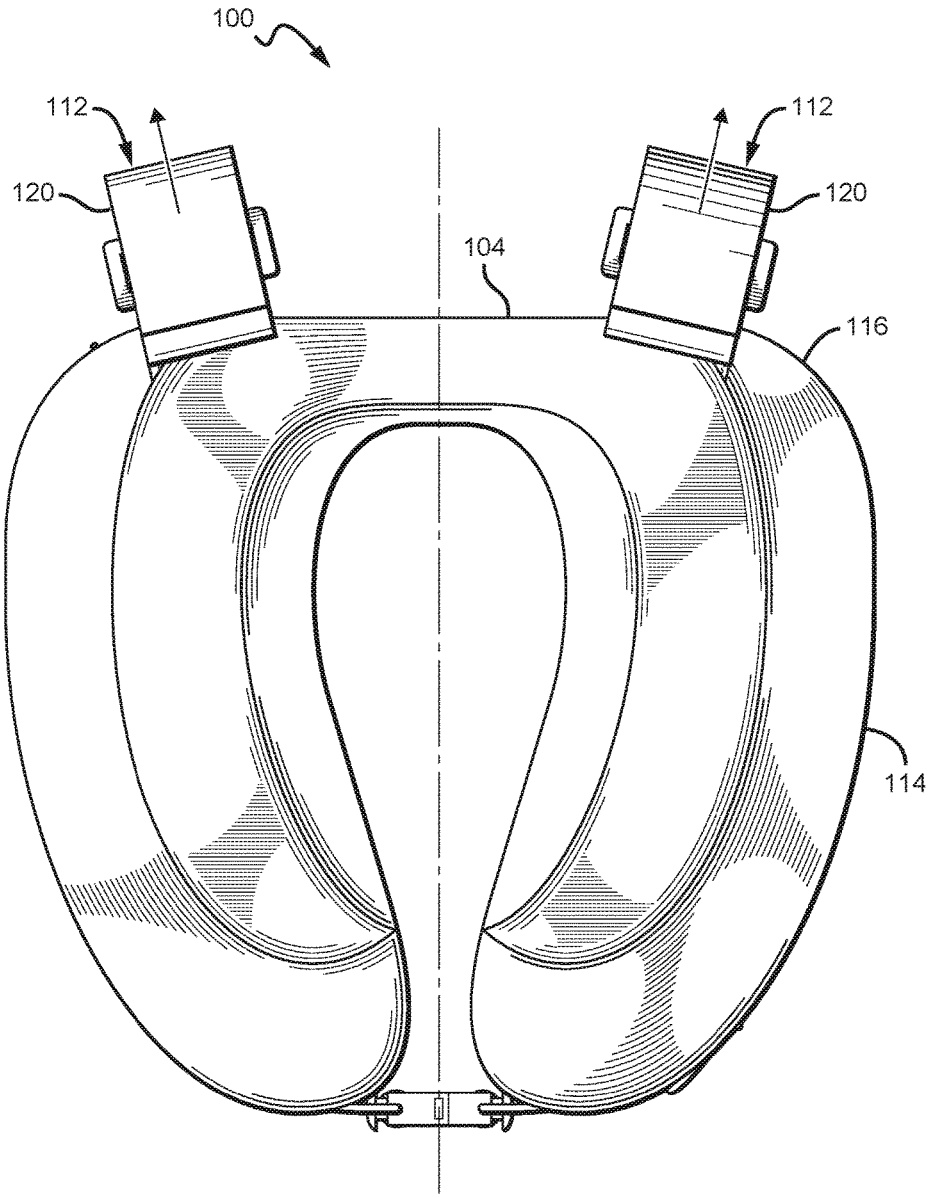
FIG. 7 is a top view of the travel pillow shown in FIG. 1.

In the specific embodiment shown and as best seen in FIG. 7, the anchor mechanisms 112 are attached in a manner so as to span portions of both 1) the rear walls 104, and 2) the curved transition walls 116, meaning they are attached partially to the rear of the pillow body 102 and partially to the curved transition of the pillow body 102. The anchor mechanisms 112 in the specific embodiment shown are angled slightly outward and away from one another (as shown by the arrows in FIG. 7), as opposed to directly rearward (as shown by the axial broken line in FIG. 7). This configuration can be particularly useful for attachment to modern seatback headrest wings. In one embodiment, the anchor mechanisms 112 and/or anchor mechanism bodies 120 are attached only to the rear walls 104*a*,104*b*, and/or are angled substantially directly rearward. In other embodiments, the anchor mechanisms 112 and/or anchor mechanism bodies 120 and components thereof are attached only to the base and/or raised curved transition walls 116*a*,116*b*.

Figure 4:
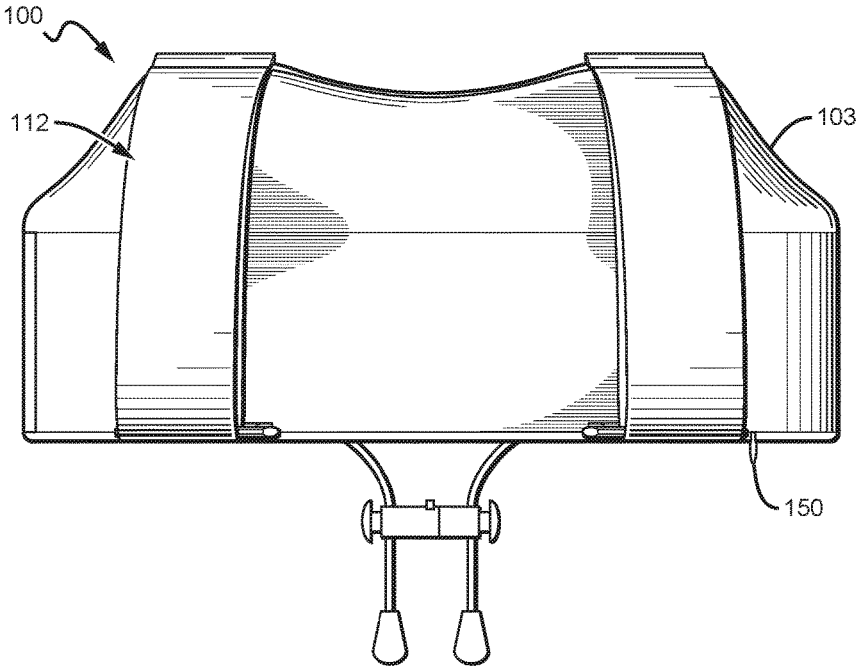
FIG. 4 is a rear view of the travel pillow shown in FIG. 1.
Figure 5:
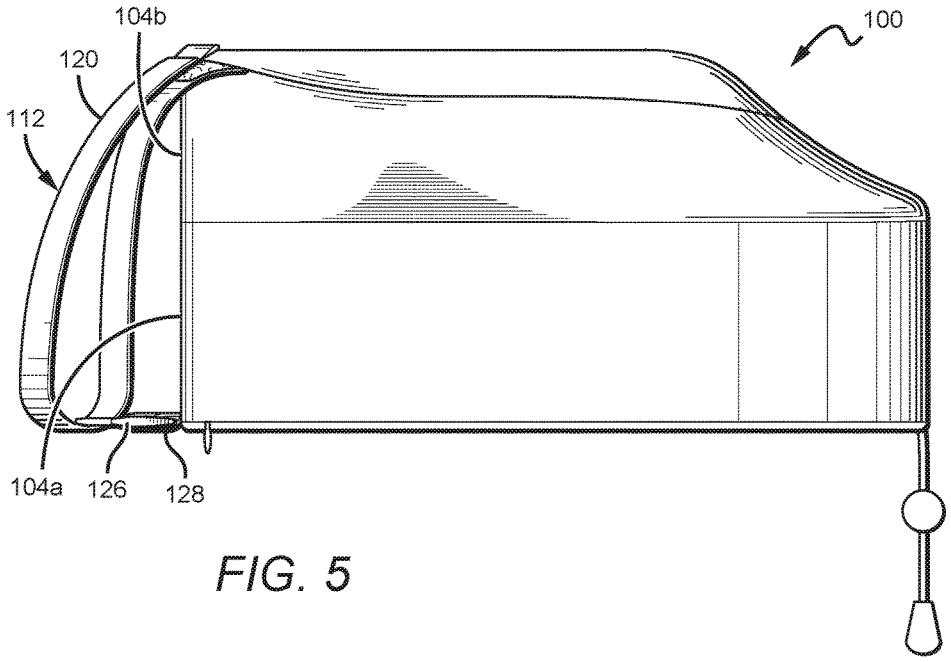
FIG. 5 is a left side view of the travel pillow shown in FIG. 1.
Figure 6:
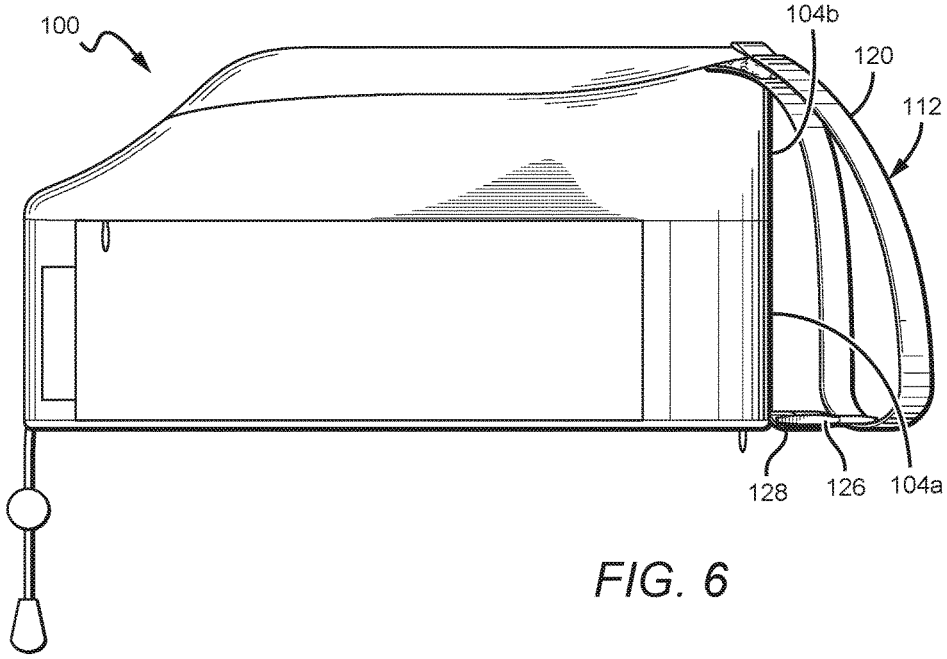
FIG. 6 is a right side view of the travel pillow shown in FIG. 1.

In some embodiments, the anchor mechanism bodies 120 are attached to the raised rear wall 104*b* and/or the top of the pillow body 102, and the anchor mechanisms 112 also include loops 126 that are attached (directly or indirectly) to the base rear wall 104*a* and/or to the bottom of the pillow body 102 as shown. The opposite configuration, with the loops 126 attached above the anchor mechanism bodies 120, is also possible. In the embodiment shown and as best seen in FIG. 4, the anchor mechanisms 112 are substantially vertically oriented and the anchor mechanism bodies 120 and loops 126 are attached substantially directly above or below one another. In other embodiments, the anchor mechanisms 112 and/or anchor mechanism bodies 120 are not exactly directly vertical, but instead approach one another from top to bottom, or move away from one another from top to bottom. In some embodiments, the anchor mechanisms 112 and/or anchor mechanism bodies 120 can be diagonal or substantially horizontal. The attachment points 118 as shown are at the top of the body 102, though it is understood that they can be placed elsewhere, such as at the junction between the base and raised portions 102*a*, 102*b*. Similarly, the loops 126 are shown as attached to the bottom of the base portion 102*a*, but it is understood that they can be placed elsewhere, such as at the junction between the base and raised portions 102*a*,102*b*. The attachment points 118 and other attachment points described herein can be static, in that the portion of the anchor mechanism body attached at the attachment point is substantially immovable relative to the cover and/or is permanently attached to that portion of the cover, such as by stitching. In other embodiments, attachment points 118 can be movable.

The anchor mechanisms 112 can include fasteners 122 (in the embodiment shown, including the fasteners 122*a*,122*b*, referred to generically herein as fasteners 122). Fasteners 122 can be, for example, hook-and-loop fasteners such as those provided by Velcro®. As used herein, the singular "fastener" may refer to one component designed to be utilized with a corresponding component to connect (e.g., the hook portion of a Velcro connection is a fastener, as is the loop portion). Many other types of fasteners, including but not limited to fasteners that allow the anchor mechanism bodies 120 to stick or otherwise attach to themselves and other types of mechanical fasteners, are possible. For instance, fasteners including snap connectivity or adhesives are possible. Fasteners 122 according to the present disclosure can have the same or smaller width as the anchor mechanism body widths described above, and in one embodiment have approximately the same width as their respective anchor mechanism bodies, and in another embodiment have widths slightly smaller than their respective anchor mechanism bodies. Fasteners 122 can have a width of, for example, ¼" to 4", or ½" to 3", or 1" to 2", or 1" to 1 15/16" inches, or about 1⅜", or about 1.5". Fasteners 122 can have a length of, for example, ¼" to 4", or ½" to 3", or 1" to 2", or 1" to 1 15/16" inches, or about 1⅜", or about 1.5".

One fastener 122*a* on each anchor mechanism body 120 can be proximate, adjacent, and/or in contact with its respective attachment point 118. The fasteners 122*a* can be outward facing (i.e., facing away from the travel pillow body 102). Another fastener 122*b* (shown in FIG. 9) can be proximate and/or adjacent the end of each anchor mechanism body 124, the fasteners 122*b* being distal from the fasteners 122*a* so as to provide a suitable length of anchor mechanism body therebetween for forming a loop for looping around a headrest wing. The fasteners 122*b* can then be fastened to the fasteners 122*a* such that the anchor mechanism bodies 120 form a loop, which can be anchored/looped around, for example, a portion of a headrest. The anchor mechanism bodies 120 can be taut and/or stretched in this configuration. In an alternative configuration, the fasteners 122*b* on each of the anchor mechanism bodies 120 can connect to the fasteners 122*a* of the other anchor mechanism body 120 so as to form an "X" or cross pattern, which can provide for an extra secure connection between the travel pillow 100 and a seat or headrest. While the fasteners 122*a* and other similar fasteners throughout the present disclosure are shown along their respective anchor mechanism bodies such as the anchor mechanism bodies 120, it is understood that they can be located in other positions, such as on the travel pillow body 102 (e.g., the cover 103), and more specifically, such as on the travel pillow body 102 (e.g., the cover 103) near an attachment point 118.

As mentioned above, the travel pillow 100 can also include connection devices (referred to herein for simplicity as "loops") such as loops 126. The loops 126 can be, for example, D-loops (as shown) or other types of closed loops. Open loops (e.g., a C-shape) are also possible, with the pillow body 102 or another device acting to close the loop (e.g., to form a D-shape or O-shape). In some embodiments, the loops 126 are closed loops that can be opened, such as carabiners or similar devices. The loops 126 can be attached directly to the body 102, or alternatively auxiliary connection devices such as the auxiliary connection devices 128 can be used. In the embodiment shown, the auxiliary connection devices 128 are stretchable, elastic, and/or non-rigid, whereas the loops 126 are rigid. It is understood that many different embodiments are possible. In some other embodiments, rigid loops and/or auxiliary connection devices can be used along with detachable anchor mechanism bodies.

Embodiments with any number of loops are possible; for instance, embodiments with one loop total or per anchor mechanism, two loops total or per anchor mechanism, three loops total or per anchor mechanism, four loops total or per anchor mechanism, or more, are all possible. The loops 126 can be, for instance, cloth, cord, string, rope, nylon, poly cord, rubber, elastic, polyester, parachute cord, webbing, plastic, composite, metal, or other devices and materials as known in the art. Loops such as the loops 126 can be the same material as a travel pillow cover, or can be a different material. For instance, in one specific embodiment, they can be a structurally stronger material that is less likely to rip or tear than the material of the travel pillow cover.

As shown in FIGS. 17A and 17B, each anchor mechanism 112 can include one or more loops 126. Each anchor mechanism body 120 can pass through a loop 126 and attach, such as attach to itself via fasteners 122 as shown in FIG. 17A. Alternatively, as shown in FIG. 17B, the anchor mechanism bodies 120 do not pass through the loops 126 before the fasteners 122 are connected to one another (or the loop is otherwise closed). This can result in a configuration where the pillow body 102 rests at a relatively lower position, which can be advantageous for shorter users. Additionally, as previously discussed, in both of these configurations, the anchor mechanism bodies could be configured in an "X" or cross configuration instead of the traditional configuration shown. Certain embodiments of the present disclosure do not include loops 126.

The anchor mechanisms 112 and/or the anchor mechanism bodies 120 of the travel pillow 100 can be placed approximately 1" or more apart from one another (from inside edge to inside edge of the attachment points 118), or approximately 2" or more apart from one another, or approximately 3" or more apart from one another, or approximately 4" or more apart from one another, or approximately 5" or more apart from one another, or approximately 6" or more apart from one another, or approximately 8" or more apart from one another; or, can be placed approximately 1" to 10" apart from one another, or approximately 2" to 8" apart from one another, or approximately 3" to 6" apart from one another, or approximately 4" to 5" apart from one another, or approximately 4.75" from one another; or, can be placed approximately 15" or less apart from one another, or approximately 12" or less apart from one another, or approximately 10" or less apart from one another, or approximately 8" or less apart from one another, or approximately 6" or less apart from one another, or approximately 5" or less apart from one another, or approximately 3" or less apart from one another. It is understood that embodiments with measurements outside these ranges are possible. In other embodiments the anchor mechanisms 112 and/or anchor mechanism bodies 120 are less than approximately 1" apart, and can abut or overlap one another, such as in an X-pattern. The loops 126 can similarly be placed the above distances away from one another. The lateral placement of the attachment points 118 in relation to the loops 126 can be inside the placement of the loops 126, slightly inside of the placement of the loops 126, directly above the placement of the loops 126, slightly outside of the placement of the loops 126, or outside of the placement of the loops 126.

In the embodiment shown, the vertical placement of the attachment points 118 is above the loops 126, as opposed to the loops 126 being above the attachment points 118. Users generally apply a downward force to the pillow 100 when it is anchored to a headrest. Placing the attachment points 118 above the loops 126 can help to restrict the amount of unwanted movement of the pillow body 102 since the pillow body 102 is typically supported by the user's shoulders. It is understood, however, that while in the embodiment shown the attachment points 118 are shown at the top of the body 102 and loops 126 are shown at the bottom of the body 102, the reverse can be true, and the attachment points 118 can be at the bottom of the body 102 while the loops 126 are at the top of the body 102 (or generally, the loops 126 can be above the attachment points 118).

Attachment of devices to the pillow body 102, such as the attachment points 118 or the point where the auxiliary devices 128 are connected to the pillow body 102, can be at seams of the cover 102, and/or can be accomplished via stitching or sewing. Additional stitching/sewing reinforcement, thicker thread, and/or bar tack reinforcement can be applied at attachment points (such as at the attachment points 118) compared to other seams or areas of the cover 103. Placement of the attachment points 118 and/or loops 126 at seams of the cover 103 can be beneficial in that these areas can be reinforced easily, thus reducing the possibility of the attachment points and/or loops ripping while maintaining simplicity in production. As previously discussed, placements for the attachment points 118 and loops 126 other than at the top and bottom of the body 102 as shown are possible.

Anchor mechanisms 112 can include tags 134 which can be used to identify the provider of the pillow 100 or to provide other information. In some embodiments, a tag 134 can be wrapped around the end of the anchor mechanism body 120 and then attached, such as via stitching. In the embodiment shown, on the other hand, a portion of the tag 134 can be sandwiched between the anchor mechanism body 120 and the fastener 122*b*. The tag 134 can then be attached in this position, such as via stitching. This can have advantages in that the tag 134 may function less rigidly, decreasing annoyance to a user if he or she happens to be touched by the tag 134. Tags according to the present disclosure can be, for example, ⅛" to 1", or ¼" to ¾", or about ½" long when attached (whether as a single layer or, for example, as a 1" long material folded in half to form a 1" long tag).

Figure 3:
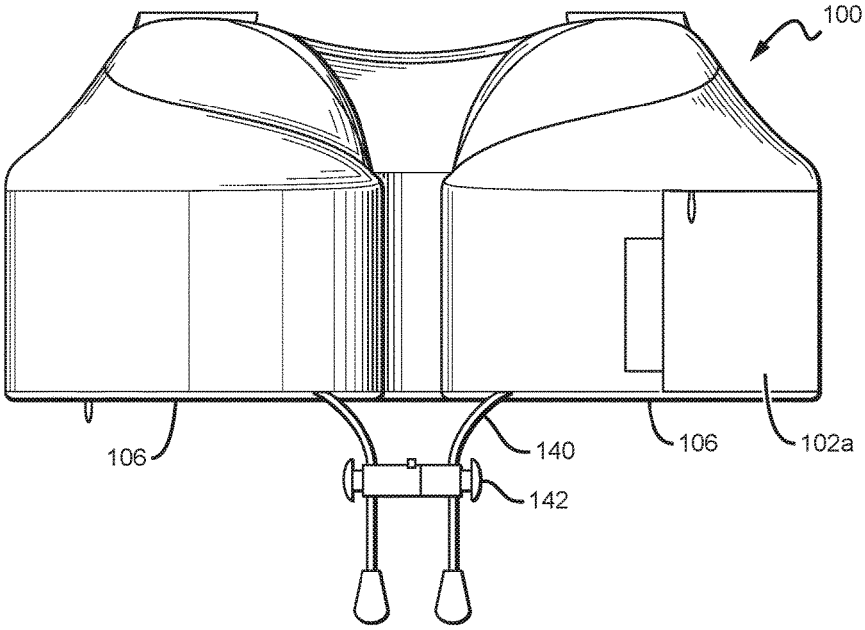
FIG. 3 is a front view of the travel pillow shown in FIG. 1.

FIG. 3 shows a front view of the pillow 100 with drawstring halves 140 extending out of both front ends of the base portion 102*a* for bringing the legs 106 together or nearer one another, such as two drawstring halves 140 and a cinch mechanism or fastener (referred to herein simply as a "cinch mechanism") such as those described in U.S. Pat. No. 9,635,962 and U.S. Pub. No. 2017/0086607. The drawstring halves 140 can be part of a single unit wrapping through the pillow 100 from one front end of the base portion 102*a* to the other front end of the base portion 102*a*. In some embodiments, the drawstring halves 140 are two separate units that each wrap through only a part of the base portion 102*a* or otherwise attach to the pillow body 102, such as to the base portion 102*a* and/or the cover 103. The drawstring halves 140 can be tightened to secure the pillow around the user's neck, and in some embodiments such that the pillow body legs touch one another in front of a user's neck. In some embodiments, the drawstring halves can each be attached to a portion of the cinch mechanism 142, such as those described in U.S. Pat. No. 9,635,962 to Sternlight or U.S. Pat. App. Pub. No. 2017/0086607 to Wong et al., for adjusting and maintaining the position of the drawstring halves 140 and cinch mechanism 142 after tightening. The cinch mechanism 142 can include two halves or parts that connect to each other, such as via a mechanical and/or magnetic connection. The cinch mechanism 142 can be used in any embodiments of the present disclosure, as can similar mechanisms.

When the anchor mechanisms 112 are engaged with an object such as a headrest, and the cinch mechanism is tightened, the pillow 100 can prevent a user's body from falling forward. For instance, the user's chin can encounter the pillow body legs. The pillow body legs which, if not anchored, would simply fall forward with the user and remainder of the pillow, can be held relatively in place via the attachment to the headrest supplied by the anchor mechanisms 112. As such, a user's head and body falling forward can be prevented. It is understood that the anchor mechanisms 112 have additional benefits without the use of a cinch mechanism, such as securing of the user's pillow to a specified location and helping to prevent falling to the side. Yet another benefit is that if attached, the pillow 100 will remain attached to the seat when a user gets up to move around, e.g., an airplane cabin.

The connections discussed herein, such as the fastener connections 122*a*/122*b*, the attachment points 118, the loops 126, the connection between the loops 126 and auxiliary connection devices 128, the connection between the auxiliary connection devices 128 and the pillow body 102, the cinch mechanism 142 (such as the two halves of a mechanical fastener), etc., can be designed to release and/or structurally fail for safety purposes when a threshold force or stress is applied.

The cover 103 can include a pocket 108 which, as shown, includes an opening at the top thereof, which can be opened and closed using a zipper mechanism 110. Other types of attachment mechanisms can be used to open and close the pocket 108 including, but not limited to, hook-and-loop fasteners such as those provided by Velcro®, buttons, snaps, adhesives, and laces, to name a few. The pocket 108 and zipper mechanism 110 can be part of the cover 103. The zipper mechanism 110 is positioned approximately along the junction between the base portion 102*a* and the raised portion 102*b*, and is shown as approximately horizontal. Other placements and orientations are possible. In some embodiments, the zipper mechanism 110 is below the junction between the base portion 102*a* and the raised portion 102*b*. In other embodiments, the zipper mechanism 110 is above the junction between the base portion 102*a* and the raised portion 102*b*. The pocket 108 can hold a user's goods, such as a mobile phone, keys, earplugs, and/or earbuds. In some embodiments, the pillow 100 has multiple pockets 108. In other embodiments, the pillow 100 has no pockets 108. In some embodiments the pillow has one or more pockets without a zipper mechanism 110. In some embodiments, the pocket 110 has dividers and/or sub-compartments within the pocket 110.

Additionally, the cover 103 can also include a zipper to allow access to a core of the pillow body 102. For instance, as best seen in FIG. 4, the cover 103 can include a zipper 150 that can be opened, and the core and cover 103 can be separated from one another such that the cover 103 can be separately washed.

FIGS. 9-16 show the pillow 100 in a configuration with the anchor mechanisms 112 open or unattached. The fastener 122*b* adjacent the ends of the anchor mechanism bodies 124 are not attached to the fasteners 122*a*. In this open position, the user can position the pillow 100 next to a headrest, then loop and/or close the anchor mechanisms 112 around the headrest or a part of the headrest. The tags 134 can be used as grasping devices to position the anchor mechanism bodies 120 such that the fasteners 122*a*,122*b* are coupled together.

FIGS. 18-25 and FIGS. 26-33 show the pillow 100 with specific combinations of features shown in solid line. For instance, the pillow 100' from FIGS. 18-25 includes a pillow body 102' (with or without a cover) and anchor mechanisms 104', which include anchor mechanism bodies 106', loops 108', and fasteners 110' (with or without auxiliary connection devices 128'). The pillow 100" from FIGS. 26-33 includes a pillow body 102" and anchor mechanisms 104", including anchor mechanism bodies 106" and fasteners 110". It is understood that embodiments of the present disclosure can include these combinations of features, with or without additional features described herein, and with or without other additional features. It is further understood that one or more elements of these embodiments can be removed, or can be replaced by another similarly functioning element or another element altogether. Many embodiments are possible.

FIGS. 34-41 show an embodiment of a travel pillow 200 that is similar in shape to those travel pillows described in U.S. Pat. No. 9,635,962 to Sternlight. The travel pillow 200 is similar to the travel pillow 100, and can have a body 202 that includes a cover 280 with a core therein, such as a memory foam core. The body 202 can include a base cushion or base portion 202*a* and a raised cushion or raised portion 202*b*, which in one embodiment are integral with one another. While the cover 280 is different than the cover 103, it is understood that all other elements and characteristics of this embodiment can be similar to or the same as those of the travel pillow 100.

The cover 280 can be made of a variety of different materials and combinations of materials and can include different regions. In the specific embodiment shown, the cover 280 includes a first region 280*a* of a first material and a second region 280*b* (shown with stipple shading instead of line shading) of a second material different than the first material. In this specific embodiment, the second region substantially corresponds to the top and inside surfaces of the raised cushion 202*b*, while the first region substantially corresponds to the remainder of the cover. In another embodiment, the second region substantially corresponds to the raised cushion 202*b* while the first region substantially corresponds to the base cushion 202*a*. In another embodiment, the second region substantially corresponds to the entire inner surface of the base and raised cushions 202*a*, 202*b*, while the first region substantially corresponds to the remainder of the cover. In another embodiment, the second region substantially corresponds to the entire inner surface of the base and raised cushions 202*a*,202*b*, as well as the top surface of the raised cushion 202*b*, while the first region substantially corresponds to the remainder of the cover. In some embodiments, the second region is 50% or less of the total cover area, or 40% or less of the total cover area, or 30% or less of the cover area, or 25% or less of the cover area, or 20% or less of the cover area, or 15% or less of the cover area, or 10% or less of the cover area. In some embodiments, the second region is 5%-45% of the total cover area, or 10%-30% of the cover area. Many different region arrangements are possible, and it is further understood that travel pillows and covers thereof according to the present disclosure can include only a single region and/or material, or can include three or more regions and/or materials.

Many different materials are possible for the cover, including for the first region and the second region. For example, materials such as cloth, polyester, cotton, blends, velour, mesh, and combinations thereof are possible. One example of a composite cover material according to the present disclosure can include hypoallergenic, antimicrobial, and/or odor protection technology, such as metallic fibers like silver fibers. Other types of fibers, such as plastic fibers and composite fibers, for example, are also possible. One such example of a composite material including metallic fibers that can be used in embodiments of the present disclosure is the XT2® material available from Noble Biomaterials, which uses silver fibers. Such fibers can be blended with other cover materials that in some embodiments are more traditional materials, such as those described above, to form the composite material. For example, one composite cover material includes approximately 80-99% traditional material (such as polyester, cotton, etc.), and/or approximately 1-20% fiber material (such as the XT2 silver fibers) by weight; or approximately 85-97% traditional material, and/or approximately 3-15% fiber material; or approximately 90-95% traditional material, and/or approximately 5-10% fiber material. Some embodiments of cover material include 1% or more fiber material, 3% or more fiber material, 5% or more fiber material, 7% or more fiber material, or 10% or more fiber material. Some embodiments of cover material include 20% or less fiber material, 15% or less fiber material, 10% or less fiber material, 7% or less fiber material, or 5% or less fiber material. Some embodiments include approximately 7% fiber material.

Composite materials utilized in covers according to the present disclosure can have different densities, such as approximately 25-250 g/m$^2$, or approximately 100-200 g/m$^2$, or approximately 125-175 g/m$^2$, or approximately 145 g/m$^2$, or 25 g/m$^2$ or higher, or 50 g/m$^2$ or higher, or 100 g/m$^2$ or higher, or 125 g/m$^2$ or higher, or 300 g/m$^2$ or lower, or 250 g/m$^2$ or lower, or 200 g/m$^2$ or lower, or 175 g/m$^2$ or lower, or 150 g/m$^2$ or lower. Many different embodiments are possible, and it should be understood that the above ranges and numeric examples are for exemplary purposes only, and materials with properties outside these ranges are also possible.

Other materials are also possible. For example, one material that can be used in one or more regions of the cover is Dri-Lex®, available from Faytex Corp.; similar materials can also be used. Such materials can transfer heat and mass (e.g., moisture) out of the cover and/or redistribute them throughout the cover, as opposed to allowing heat or mass to gather in specific areas that may cause user discomfort, such as around the neck. Specifically, the Dri-Lex Honeycomb P material can function well in this regard, as can other honeycomb materials as known in the art. These materials could be used, for example, in regions other than where the previously described composite materials are used, such as, for example, in the previously-described first regions such as the first region 280*a*, or could be used in the second regions such as the second region 280*b*.

Composite materials such as those described above can make up substantially the entire cover, or just one region of the cover, such as the second regions described above. For example, in one specific embodiment, the second region 280*b* shown in FIG. 33 or any of the other second regions described above includes a composite material. Use of these composite materials in the above-described second regions can be particularly beneficial, as they can provide antimicrobial properties in areas near a user's mouth, which can be the source of microbes that can eventually impart an odor or bacteria on the cover 280. The composite materials described herein can also have a moisture resistant wicking effect compared to some more traditional materials. As such, use of the composite materials in areas near a user's mouth and/or user's neck (where the user's neck abuts the pillow) can be beneficial in preventing sickness, providing a cooling effect, and providing a moisture-reducing effect, while other areas of the pillow can use other materials to reduce costs or provide durability. Similarly, the honeycomb style materials described above can be used to make up substantially the entire cover, or just one region of the cover, such as one of the first regions described above (with one of the composite materials previously described, for example, making up the corresponding second region).

Additionally, the different material concepts described with regard to FIGS. 33-41 can also be utilized with other pillow bodies. For example, the body 1202 in FIGS. 49A and 49B could include a cover, and the area of the cover corresponding to the protrusions 1202*a*,1202*b* could correspond to a second region as previously described, while other elements (and in some embodiments, the remainder of the cover) could correspond to the first region. Many different embodiments are possible.

Many different materials can be used for the body of pillows according to the present disclosure, whether or not those pillows include anchor mechanisms. In embodiments including anchor mechanisms, the type of material can work in conjunction with the anchor mechanisms to provide a secure connection therebetween. The covers, regions, materials, and concepts shown and described with regard to FIGS. 33-41B can all be combined with the embodiments shown in FIGS. 1-32 and those embodiments described further below.

Figure 42:
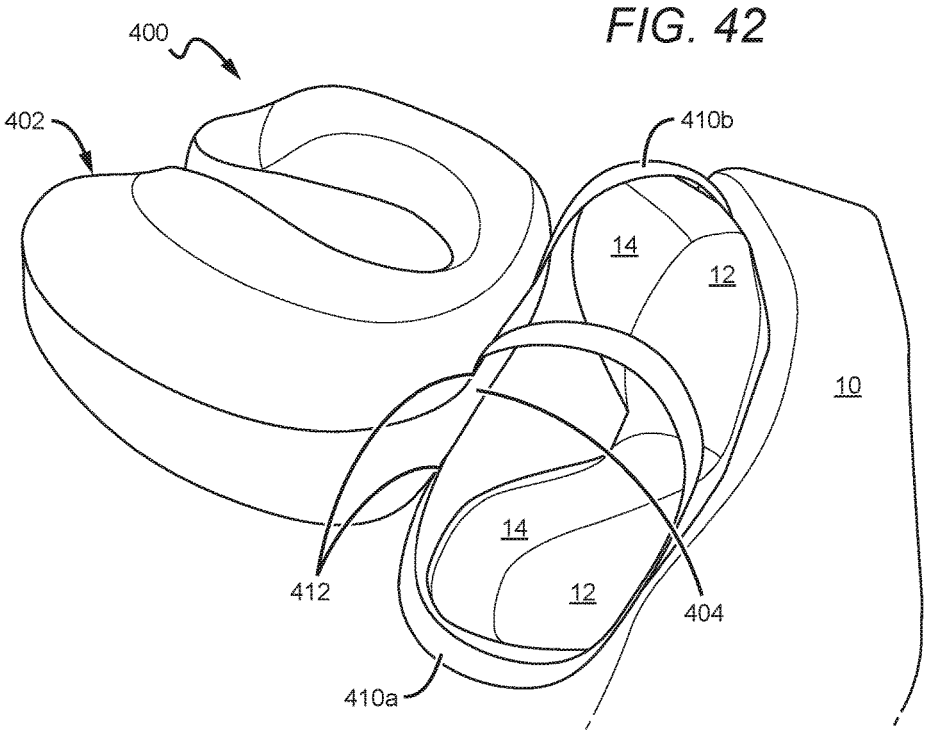
FIG. 42 is a perspective view of another embodiment of a travel pillow according to the present disclosure.

FIG. 42 is a rear perspective view of another embodiment of a travel pillow 400 according to the present disclosure, attached to the headrest 12 of the seat 10. The headrest 12 includes wings 14. The travel pillow body 402 may include many features described in U.S. Pat. No. 9,635,962 to Sternlight, such as a substantially flat rear wall 404, though it is understood that embodiments of the present disclosure can include many different styles of travel pillow body, such as those described in PCT Pat. App. Pub. No. WO/2015/138654 to Wong et al. and U.S. Pub. No. 2017/0086607 to Wong et al. The pillow 400 can include one or more anchor mechanisms consisting of or comprising anchor mechanism bodies, such as the two vertically-oriented anchor mechanism bodies 410*a*,410*b*. The anchor mechanism bodies 410*a*,410*b* can loop around the wings 14, which can prevent or make less likely the forward movement of the travel pillow body 402. The travel pillow body 402 can also include mechanisms for bringing legs 106 together or nearer one another, such as two drawstring halves and a cinch mechanism such as those described in U.S. Pat. No. 9,635,962, such as those cinch mechanisms previously described herein, and such as the cinch mechanism 820 shown in FIG. 49 and more fully described below. Thus, when the anchor mechanism bodies 410*a*,410*b* are engaged with the wings 14, the user falling forward is prevented or made less likely, and when the travel pillow body 402 is arranged such that the legs 406 are secured together or nearer one another, the user falling forward is further prevented or made less likely.

Figure 43A:
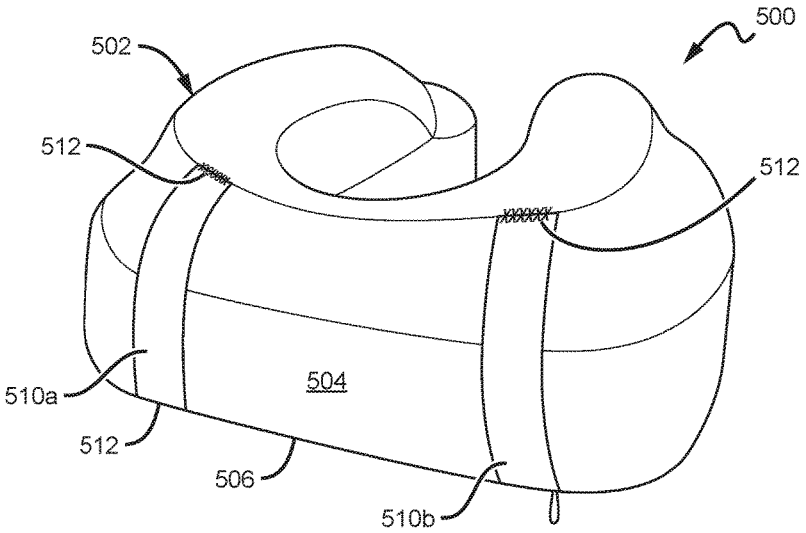

The anchor mechanism bodies 410*a*,410*b* can be made of many different materials and take many different shapes. The anchor mechanism bodies 410*a*,410*b* can be, for example, straps (such as elongated straps as shown), cords, strings, ropes, or other flexible, rigid, or non-rigid devices as known in the art. The anchor mechanism bodies 410*a*,410*b* can be elastic, as described below with regard to FIGS. 43A and 43B, or inelastic, and can be cloth, cord, string, rope, nylon, poly cord, rubber, polyester, parachute cord, webbing, or other devices and materials as known in the art. Each of the anchor mechanism bodies 410*a*,410*b* is attached to the pillow body 402 at two points 412. In the specific instance shown, the points 412 are at the top and bottom of a base portion of the rear wall 404, though it is understood that these points can be in many different positions, such as at the top and bottom of the rear of the pillow body (as shown in the embodiment of FIGS. 43A and 43B, described below). Additionally, fewer or more than two attachment points for each of the anchor mechanism bodies 410*a*,410*b* is possible, including a single attachment point or three or more attachments points. The attachment points 412 need not be on the rear of the pillow but could also be elsewhere, such as to a side or transition portion of the pillow body 402. The anchor mechanism bodies could also include a single long attachment to a pillow body. For instance, each of the anchor mechanism bodies 410*a*,410*b* could itself be a closed loop, with a portion of the closed loop attached to the body 402. The attached portion could be, for example, ⅛" or more, ¼" or more, ½" or more, ¾" or more, 1" or more, or 1.5" or more, or even longer. In some embodiments the anchor mechanism bodies can closed loops that are attached at one point, two points, or more than two points. Further, each of the anchor mechanism bodies 410*a*,410*b* could be attached to the outside of the body 402 (such as to the outside surface of a body cover), or to an inner surface of the body 402, such as the inner surface of a travel pillow cover or the foam core of a travel pillow body. In one embodiment where the anchor mechanism bodies 410*a*,410*b* are closed loops, they can run through the cover (as opposed to outside the cover, which is also possible in another embodiment). Embodiments without closed loops can also run through the cover. One specific embodiment includes anchor mechanism bodies comprising closed loops connected to a single attachment point, such as being connected via stitching or via a single strap/cord/etc. Many different embodiments are possible.

Additionally, while the embodiment of FIG. 42 and some other embodiments shown herein include substantially vertical anchor mechanism bodies, and FIG. 45 includes a substantially horizontal anchor mechanism body, other arrangements are possible. For example, anchor mechanism bodies could be arranged diagonally, such that in one embodiment they are nearer one another or meet one another at the top, and in another embodiment nearer one another or meeting one another at the bottom. In another embodiment, the anchor mechanism bodies cross one another, or form an X-shape. Many different embodiments tailored to meet different headrest shapes are possible.

FIGS. 43A and 43B show another embodiment of a travel pillow 500 with a body 502 including rear wall 504. The pillow 500 includes two anchor mechanism bodies 510*a*, 510*b*. In the specific embodiment shown, the anchor mechanism bodies 510*a*,510*b* are elastic such that they can be stretched to the positions shown by 510*a*',510*b*' in FIG. 43B or even beyond, and thus are configured to form a loop (in this case, an open loop, with the body 502 serving to close the loop). The elasticity of the anchor mechanism bodies 510*a*,510*b* can thus cause the anchor mechanism bodies 510*a*,510*b* to self-tighten when placed around, for example, headrest wings such as the headrest wings 14 shown in FIG. 42. The anchor mechanism bodies 510*a*,510*b* and the loops formed thereby can be substantially flush against the body 502 when in a resting position that is less stretched than when the anchor mechanism bodies 510*a*,510*b* are engaging another object, such as the wings 14. When in a resting position, the anchor mechanism bodies 510*a*,510*b* can be stretched, at least slightly stretched, at their equilibrium length, at least slightly slack, or slack. An embodiment with the anchor mechanism bodies 510*a*,510*b* at least slightly stretched while in the resting position can aid in keeping the anchor mechanism bodies substantially flush or near flush against the body 502, while also providing stretching capability that enables looping around, e.g., wings 14. An embodiment with the anchor mechanism bodies 510*a*,510*b* at their equilibrium length or slightly slack can aid in preserving the material's elasticity, while also keeping the anchor mechanism bodies relatively close to flush.

Anchor mechanism bodies according to the present disclosure, such as the anchor mechanism bodies 510*a*,510*b*, can have many different sets of dimensions and can take many different shapes and configurations. In one embodiment, when in the resting position shown in FIG. 43A, each of the anchor mechanism bodies 510*a*,510*b* can be approximately 1" to 10" in length, or approximately 2" to 7" in length, or approximately 3" to 5.5" in length, or approximately 3.75" to 4.75" in length, or approximately 4" to 4.5" in length. The anchor mechanism length can be 25% or more of the height of the pillow, 50% or more of the height of the pillow, 75% or more of the height of the pillow, substantially the height of the pillow, or longer than the height of the pillow. The length can be increased via stretching to a stretched position, such as that shown in FIG. 43B, to a maximum length of approximately 3" to 30", or approximately 4" to 24", or approximately 6" to 18", or approximately 7" to 16", or approximately 12". Each of the anchor mechanism bodies 510*a*,510*b*, can have a width of approximately 0.25" to 4", or approximately 0.5" to 3", or approximately 1" to 2", or approximately 1.5". The above dimension ranges can also apply to anchor mechanism bodies that do not substantially stretch, such as inelastic materials. It is understood that anchor mechanism bodies with lengths outside these ranges are possible. The anchor mechanism bodies 510*a*,510*b* and other anchor mechanism bodies described herein can be placed apart from one another at the same or similar distances as previously described with regard to the anchor mechanisms 112.

Each of the anchor mechanism bodies 510*a*,510*b* in the specific embodiment shown is attached at two attachment points 512, such as by stitching. The attachment points 512 can include, for instance, bar tack reinforcement (as shown by the "x" markings in the figures), which can aid in withstanding the stresses associated with looping the anchor mechanism bodies 510*a*,510*b* around headrest wings and the stresses associated with a user's head or body leaning or falling forward. The attachment points 512 can be at a seam of the travel pillow body (such as at a seam of a cover), which can aid in strength and ease of manufacture.

Combinations of the elements from the embodiments described herein, such as elements of the travel pillow 100 with elements of the travel pillow 500, are possible. For instance, while the travel pillow 500 includes anchor mechanism bodies 510*a*,510*b* that are permanently attached to the travel pillow body 502, in an alternative embodiment, only one end of each of the anchor mechanism bodies 510*a*,510*b* is permanently attached, while the other is removably attached or detachable. For instance, the travel pillow 500 could include a fastener component (such as part of a hook and loop fastener) at each of the lower attachment points 512, while each of the anchor mechanism bodies 510*a*,510*b* can include a corresponding fastener component (such as the other part of a hook and loop fastener) along its length and distal from the upper attachment points 512. Thus, the anchor mechanism bodies 510*a*,510*b* could be wrapped around headrest wings and then reattached to the travel pillow body at the fastener components at the lower attachment points 512. Other embodiments, such as the reverse (where the anchor mechanism bodies are attached permanently only at the bottom attachment points and removably to the top attachment points) or where the anchor mechanism bodies are only removably attached, are possible. The anchor mechanism bodies can be elastic so as to tighten around headrest wings, or can include another tightening mechanism such as those described with regard to other embodiments described herein.

Other types of attachment and reinforcement are also possible either alone or in various combinations, including stitching, sewing, adhesives such as glue or epoxy, rivets, snaps, and other attachment and reinforcement mechanisms. In one embodiment a snap, buckle, or similarly functioning connection is used, which can provide for disconnection of the anchor mechanism bodies from 510*a*,510*b* from the body 502 at a certain threshold force, which can be used as a measure to increase user safety. Snaps, buckles, or similar devices can also be used at other portions of the anchor mechanism bodies 510*a*,510*b* to provide for the disconnection of pillow body 502 and anchor mechanism bodies 510*a*,510*b*, and/or for the disconnection of the anchor mechanism bodies 510*a*,510*b* from a headrest, upon a certain threshold force being met. In addition to or in place of snaps or buckles, many other types of disconnection mechanisms for disconnection of the anchor mechanisms from the pillow body, and/or for the disconnection of the anchor mechanisms from a headrest, are possible.

Similar to the travel pillow 100 and travel pillow body 102, the travel pillow body 502 can include a cover and a core therein, with a zipper opening. For instance, the travel pillow body 202 shown in FIGS. 43A and 43B includes a zipper opening 506 at the bottom of the body 502. The zipper opening 506 and the applicable attachment points 512 can be placed at the same seam, with the attachment points 512 above the zipper opening 506. Similarly, the pillow 600 of FIGS. 44A and 44B includes an opening such as a zipper opening 606, which in this case is shown at the top attachment point of the anchor mechanism bodies 610*a*,610*b*. In such an embodiment, the opening can be above the attachment mechanisms 610*a*,610*b* at the same seam.

Other tightening functionalities can be utilized in addition to or in place of elasticity. For example, a fastener tightening mechanism or cinch mechanism can be used that is similar to or the same as that used in conjunction with the drawstring mechanisms described in U.S. Pat. No. 9,635,962 to Sternlight, and/or the cinch mechanism 820 (described more fully below with regard to FIG. 49). The travel pillow 600 shown in FIGS. 44A and 44B includes a pillow body 602 and anchor mechanism bodies 610*a*,610*b* that can be tightened using cinch mechanisms 620. In the specific embodiment shown, the anchor mechanism bodies 610*a*,610*b* are string or cord, and in some instances can have a substantially circular cross-section. Many different embodiments are possible. The anchor mechanism bodies 610*a*,610*b* can be, for example, cords, strings, ropes, straps, webbing, nylon, or other similar devices, arranged to allow for the functionality of the cinch mechanisms 620. Many different types of cinch mechanisms are also possible. For example, other tightening and cinch mechanisms, such as cams or ladder lock style devices (described below with regard to FIGS. 47A and 47B) are possible.

In the embodiment of FIGS. 44A and 44B, a user is able to pull the anchor mechanism bodies 610*a*,610*b* through the cinch mechanisms 620. One, two, or more cinch mechanisms for each anchor mechanism body are possible. In order to shorten the operable length of the anchor mechanism bodies 610*a*,610*b*, they are pulled through the cinch mechanisms 620 so as to increase the total length of the tail portions 662*a*,662*b* and decrease operable length. Similarly, the anchor mechanism bodies 610*a*,610*b* can be pulled through the cinch mechanisms 620 so as to decrease the total length of the tail portions 662*a*,662*b*, thus increasing the operable length of the anchor mechanism bodies 610*a*,610*b* as a whole. In this way, the anchor mechanism bodies 610*a*,610*b* can be placed around, for example, wings 14 of a headrest 12, and then tightened (by shortening of the operable length).

In one embodiment, each of the anchor mechanism bodies 610*a*,610*b* can be approximately 6" to 48" in total length (e.g., the total distance from one attachment point, around the loop formed by the anchor mechanism, and to the second attachment point, as shown in FIGS. 44A and 44B, and including any tail portion), or approximately 8" to 36" in length, or approximately 10" to 30" in length, or approximately 12" to 20" in length, or approximately 16" in length. In some embodiments, each of the anchor mechanism bodies 610*a*,610*b* can be 6" or longer, 12" or longer, or 16" or longer; and in some embodiments, each of the anchor mechanism bodies 610*a*,610*b* can be 30" or shorter, or 24" or shorter, or 20" or shorter, or 16" or shorter. These lengths can in some instances be increased if, for example, the anchor mechanism bodies 610*a*,610*b* are made of an elastic material. It is understood that lengths outside these ranges are possible. The anchor mechanism bodies 610*a*,610*b* and other anchor mechanism bodies described herein can be placed apart from one another at the same or similar distances as previously described with regard to the anchor mechanism bodies 120.

While the embodiments of FIGS. 42-44B show embodiments including two vertically oriented anchor mechanism bodies, other embodiments are possible. For instance, FIG. 45 shows a travel pillow 700 including a body 702 and a horizontally oriented anchor mechanism 710. The anchor mechanism 710 can loop around an entire headrest or a headrest portion, for example, the wings 14, such as the corners of the wings 14 (when the anchor mechanism 710 is moved downward from the position shown in FIG. 45, as shown by the downward arrows). The anchor mechanism 710 can be connected at an attachment 712, the area of which can also include, for instance, a zipper opening or other type of opening. In another embodiment, the anchor mechanism 710 is attached to the body 702 inside of a cover of the body, meaning that it can be stored within the cover of the body 702 when the user wishes (or, if attached outside the cover, a portion thereof can be stored within the cover). The anchor mechanism 710 also includes a cinch mechanism 720, which can be used to increase/decrease the operable length of the anchor mechanism 710 (and to correspondingly decrease/increase the length of tail portion 762). It is understood that many different various are possible, including an elastic mechanism substantially similar to the anchor mechanism bodies 510*a*,510*b* described above with regard to FIGS. 43A and 43B.

The anchor mechanism 710 can in some embodiments be about 12" to 60" in length, or about 18" to 42" in length, or about 24" to 40" in length, or about 32" in length. In some embodiments the anchor mechanism 710 can be about 12" or longer, or about 18" or longer, or about 24" or longer, or about 32" or longer. In some embodiments, the anchor mechanism 710 can be about 60" or shorter, or about 42" or shorter, or about 36" or shorter, or about 32" or shorter. It is understood that embodiments with anchor mechanism lengths outside these ranges are possible.

FIG. 46A shows yet another embodiment of a travel pillow 800 including anchor mechanisms. In this embodiment, the body 802 includes one or more loops 830. In this specific case, the body 802 includes four loops 830, two for each anchor mechanism. It is understood that embodiments with any number of loops are possible; for instance, embodiments with one loop total or per anchor mechanism, two loops total or per anchor mechanism, three loops total or per anchor mechanism, four loops total or per anchor mechanism, or more. The loops 830 can be, for instance, cloth, cord, string, rope, nylon, poly cord, rubber, elastic, polyester, parachute cord, webbing, or other devices and materials as known in the art, and can be integral with a travel pillow cover or distinct elements from the travel pillow cover, such as sewed on elements as shown by the attachments 832. Loops such as the loops 830 can be the same material as a travel pillow cover, or can be a different material. For instance, in one specific embodiment, they can be a structurally stronger material that is less likely to rip or tear than the material of the travel pillow cover.

As shown in FIG. 46B, the travel pillow 800' can include anchor mechanism bodies 850 that can pass through the loops 830. The anchor mechanism bodies 850 can be, for example, straps, and in some instances can include fasteners such as hook and loop portions to provide the functionality of closing the loop. Other fasteners such as adhesive sticking portions are possible. Additionally, other types of fasteners are possible, as are other devices that function to close the loop (such as snaps, buckles, similar devices, etc.). The anchor mechanism bodies 850 can have dimensions similar to or the same as the anchor mechanism bodies 610*a*,610*b* or the anchor mechanism body 710*a* described above. It is understood that other materials and devices, such as those previously described, can be utilized for anchor mechanism bodies.

Figure 47A:
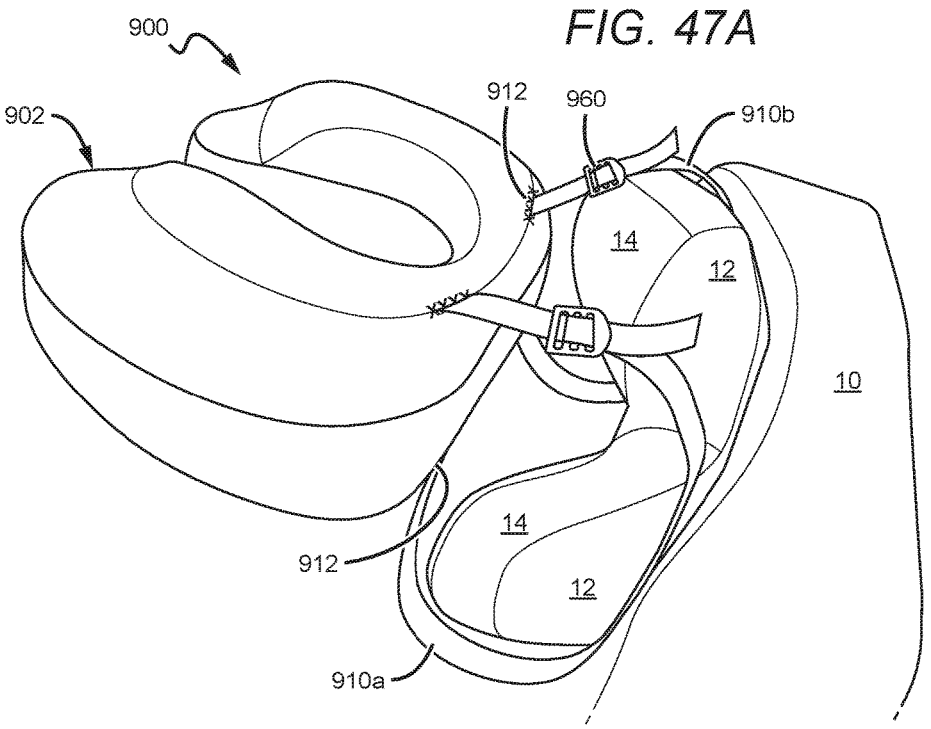
FIGS. 47A and 47B are perspective views of yet another embodiment of a travel pillow according to the present disclosure.
Figure 47B:
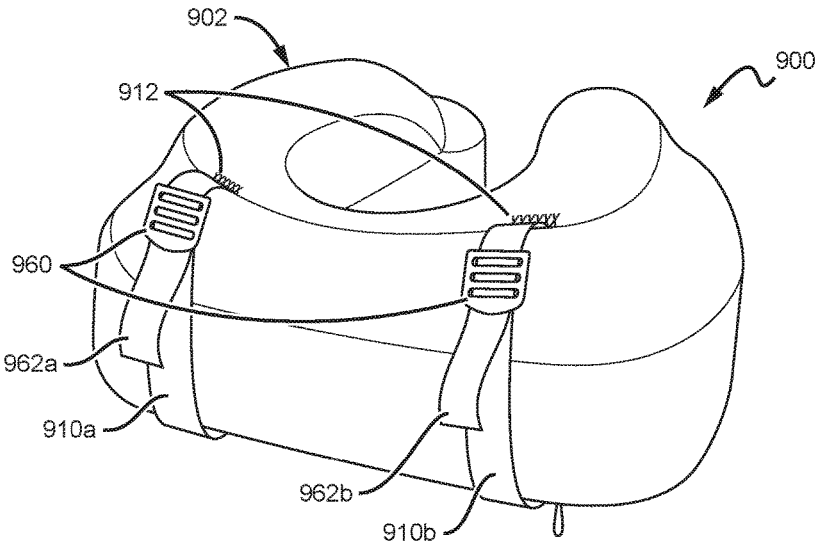

FIGS. 47A and 47B show yet another embodiment of a travel pillow 900 including anchor mechanisms, with FIG. 47A showing the travel pillow 900 with anchor mechanism bodies 910*a*,910*b* in a relatively loose configuration about the wings 14 of the headrest 12, and FIG. 47B showing the anchor mechanism bodies 910*a*,910*b* in a comparatively tighter configuration. The pillow 900 includes adjustment devices 960, which are operably attached to the anchor mechanism bodies 910*a*,910*b* to adjust the operable length of the anchor mechanism bodies 910*a*,910*b*. The adjustment devices 960 are shown in this embodiment as ladder locks, such as those used to adjust the operable length of straps on a standard backpack. It is understood that many different types of adjustment devices can be used in place of or in conjunction with ladder locks, and that adjustment devices such as ladder locks can be used in any embodiment of the present disclosure, including but not limited to the travel pillow 100 from FIG. 1.

The anchor mechanism bodies 910*a*,910*b* can be similar to or the same as those anchor mechanism bodies previously described, such as being elastic or inelastic, and made of cloth, cord, string, rope, nylon, poly cord, rubber, polyester, parachute cord, webbing, or other devices and materials as known in the art, or combinations thereof. Additionally, the adjustment devices 960 work in conjunction with the anchor mechanism bodies 910*a*,910*b*. A tail portion 962*a*,962*b* of one or both of the anchor mechanism bodies 910*a*,910*b* can be formed by drawing a portion of one of the anchor mechanism bodies 910*a*,910*b* through one of the adjustment devices 960. The tail portions 962*a*,962*b* do not form part of the operative length of the anchor mechanism bodies 910*a*, 910*b*, and in this way, those operative lengths are reduced (and the length of the tail portions increased) such that the anchor mechanism bodies 910*a*,910*b* are tightened. This can result in a tighter fit around, for instance, the wings 14. Thus, a user can adjust the operative length of the anchor mechanism bodies 910*a*,910*b* to a comfortable tightness or snugness about a headrest or headrest portions such as wings. Additionally, the combination of the anchor mechanism bodies 910*a*,910*b* and the adjustment devices 960 can be configured to loosen when a certain threshold force is applied (such as applied by forward movement of a user's head or body, or applied as tension to the anchor mechanism bodies themselves), which can aid in user safety.

The anchor mechanism bodies 910*a*,910*b* can be attached to the pillow body 902 at any number of locations, as described above with regard to other embodiments. In the specific embodiment shown, the anchor mechanism bodies 910*a*,910*b* are each attached to the pillow body 902 at top and bottom attachment points 912, with the top attachment points 912 substantially at the top of the pillow body 902 and the bottom attachment points 912 substantially at the bottom of the pillow body 902. However, as previously described, many different arrangements of the attachment points 912 (including arrangements with only a single attachment point per anchor mechanism, a continuous attachment point per anchor mechanism, or three or more attachment points per anchor mechanism, for example) are possible. The anchor mechanism bodies 910*a*,910*b* can have dimensions similar to or the same as the anchor mechanism bodies 610*a*,610*b* or the anchor mechanism body 710*a* described above.

Figure 48A:
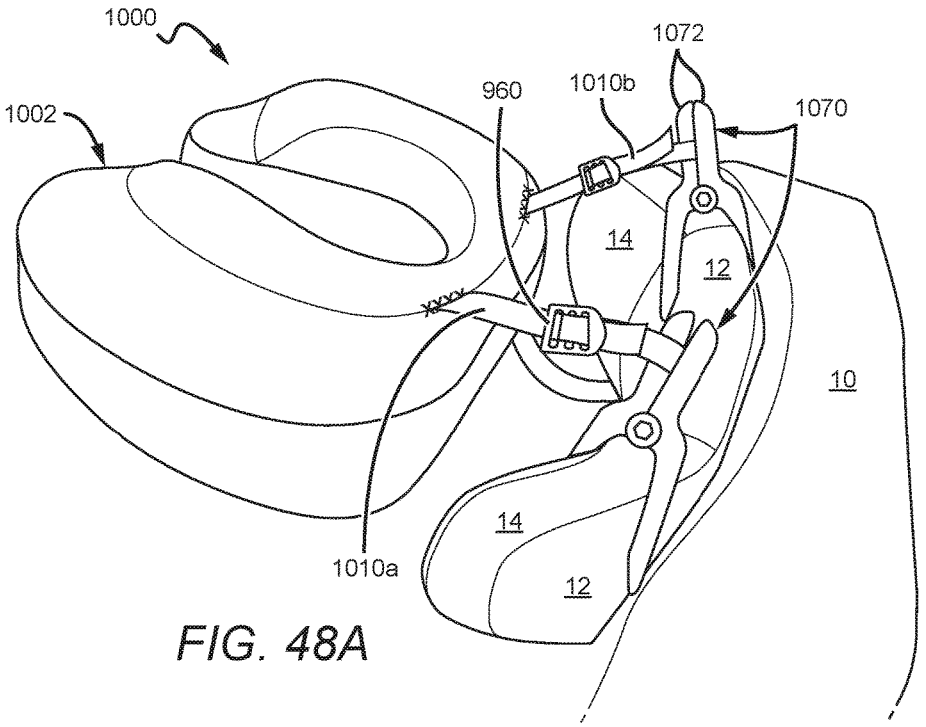
FIGS. 48A and 48B are perspective views of yet another embodiment of a travel pillow according to the present disclosure.
Figure 48B:
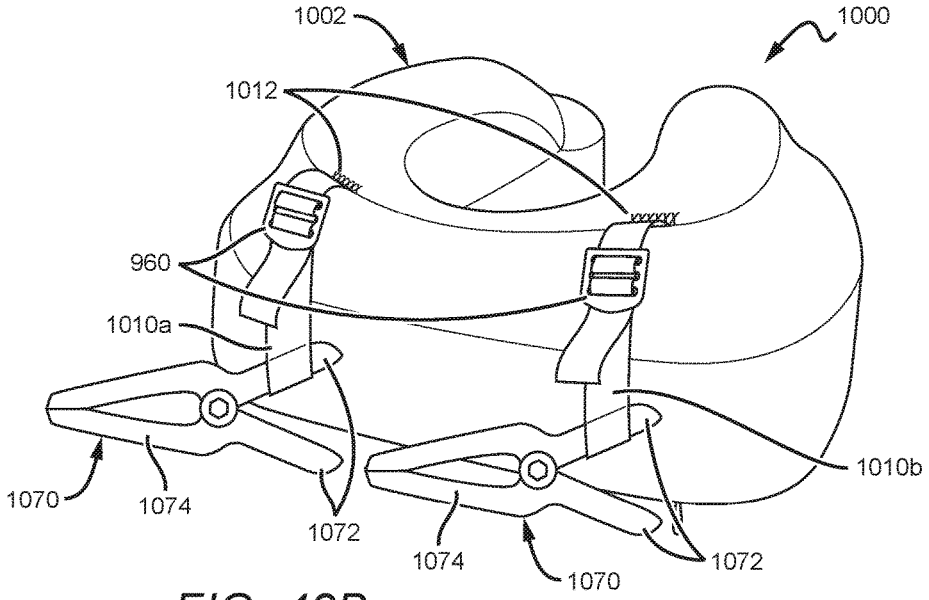

FIGS. 48A and 48B show yet another embodiment of a travel pillow 1000 including anchor mechanisms, with FIG. 48A showing the travel pillow 1000 with anchor mechanism bodies 1010*a*,1010*b* attached to a seatback 10, such as at the headrest 12 (including but not limited to the wing portions 14), and with FIG. 48B showing a rear perspective view of the pillow 1000. The anchor mechanism bodies 1010*a*, 1010*b* can be similar to or the same as those anchor mechanism bodies previously described with regard to devices and materials used to form the anchor mechanism bodies, and can be connected to a pillow body 1002 at attachment points 1012 that can be substantially similar to or the same as previously described attachment points.

Each of the anchor mechanism bodies 1010*a*,1010*b* can be connected, such as connected at one end, to an attachment mechanism such as one of the attachment mechanisms 1070.

The attachment mechanisms 1070 can be, for example, clip-style mechanisms, grasping mechanisms, spring-loaded mechanisms, biased mechanisms such as spring-biased mechanisms, hook mechanisms, or other styles of attachment mechanisms as known in the art. The attachment mechanisms 1070 are shown in FIG. 48A as being clipped to, grasping, or otherwise being connected to the headrest 12, while the attachment mechanisms 1070 are shown in FIG. 48B in their resting position. In the specific resting position shown, clip portions 1074 are shown as closed, though it is understood that in other embodiments these clip portions 1074 may not completely close and a gap may remain.

In the specific embodiment shown, each of the anchor mechanism bodies 1010*a*,1010*b* is connected to one leg portion 1072 of one of the attachment mechanisms 1070, though it is understood that an anchor mechanism can be connected to an attachment mechanism in another manner, such as connection to two of the leg portions 1072 or to another portion or portions of the attachment mechanism. Additionally, the anchor mechanism bodies 1010*a*,1010*b* are shown as connected to the pillow body 1002 at only one attachment point 1012 each, that attachment point 1012 being at the top of the pillow body 1002. However, it is understood that the single attachment points 1012 could be located elsewhere, and further understood that in other embodiments multiple attachment points per anchor mechanism may be used.

The use of anchor mechanism such as those shown in FIGS. 48A and 48B can be particularly applicable to shorter users. The use of the attachment mechanisms 1070 allows a user to place the attachment mechanisms 1070 at a higher height relative to the user's head, where some other styles of anchor mechanisms may be able to connect to a headrest when in use by a relatively taller user. Users can connect the anchor mechanisms to many different areas on a headrest, including the tops of wings, bottoms of wings, sides of wings, or areas of a headrest not corresponding to wings. Additionally, use of anchor mechanism bodies 1010*a*,1010*b* that are connected at only one attachment point, such as the attachment points 1012 substantially at the top of the pillow body 1002, can also allow for the anchor mechanism bodies 1010*a*,1010*b* to reach to heights that may not be able to be reached by other anchor mechanisms. The anchor mechanism length from the pillow body to the attachment mechanism can be, for example, about 0.5" to about 18", or about 1" to about 12", or about 2" to about 10", or about 3" to about 8", or about 4" to about 7". The anchor mechanism length from the pillow body to the attachment mechanism can in some embodiments, for example, be about 0.5" or longer, or about 1" or longer, or about 2" or longer, or about 3" or longer, or about 4" or longer, or about 6" or longer, or about 8" or longer, or about 10" or longer, or about 12" or longer; and, in some embodiments, can be about 12" or shorter, or about 10" or shorter, or about 8" or shorter, or about 6" or shorter, or about 4" or shorter. Additionally, adjustment devices such as the adjustment devices 660 or other adjustment devices can be used to adjust the length of the anchor mechanism bodies 1010*a*,1010*b*, such as to adjust the operable length within any of the above ranges.

Additionally, the attachment mechanisms 1070 can be configured to release from the headrest 12 at a certain threshold force, or when the anchor mechanism bodies 1010*a*,1010*b* are at a certain tension. Other disconnection devices can also be used. Further, as with all embodiments described herein, the anchor mechanism bodies 1010*a*, 1010*b* can be detachable from the pillow body 1001. Additionally, the attachment mechanisms 1070 may be detachable from the anchor mechanism bodies 1010*a*,1010*b*.

In one alternative embodiment, loops (such as loops formed of straps) could be used in place of the attachment mechanisms 1070, with the operable length of the loops adjustable so as to tighten around headrest wings. Many different embodiments are possible, and it is understood that anchor mechanism bodies with dimensions outside these ranges are possible.

Figure 49A:
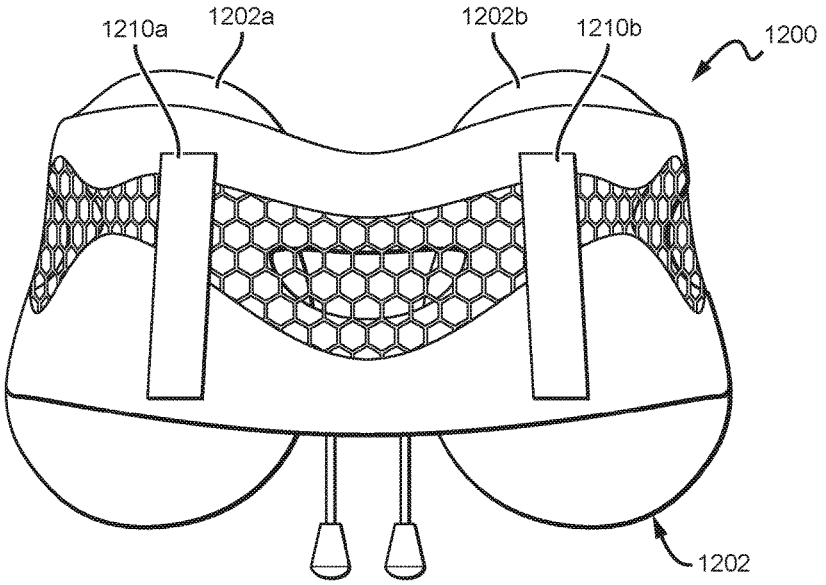
FIGS. 49A and 49B are perspective views of yet another embodiment of a travel pillow according to the present disclosure.
Figure 49B:
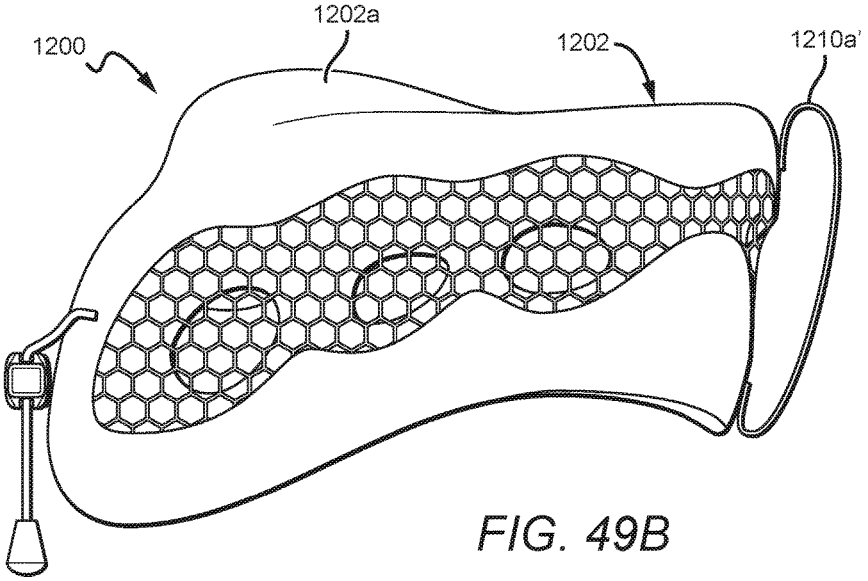

As previously described, embodiments including aspects of the present disclosure can be utilized with various different styles of pillow bodies. For example, FIGS. 49A and 49B show rear and side views of a pillow 1200 according to one embodiment of the present disclosure, including a pillow body 1202. The pillow body 1202 can be substantially similar to or the same as those described in commonly assigned PCT Pat. App. Pub. No. WO/2015/138654 to Wong et al. and U.S. Pub. No. 2017/0086607 to Wong et al., each of which is fully incorporated by reference herein in its entirety, and substantially similar to or the same as the body of the Evolution Cool® travel pillow available from Cabeau, Inc. The pillow 1200 can include anchor mechanism bodies 1210*a*,1210*b*. In the specific embodiment shown, the anchor mechanism bodies 1210*a*,1210*b* are similar to the anchor mechanism bodies 510*a*,510*b*, and can be elastic straps that can be pulled away from the pillow body 1202 (as shown by position 1210*a*' in FIG. 49B) and placed around, for example, headrest wings. The anchor mechanism bodies 1210*a*,1210*b* can have all or some of the same characteristics as the anchor mechanism bodies 210*a*,210*b*. Additionally, it is understood that any of the previously described anchor mechanisms, such as but not limited to the anchor mechanisms 112*a*,112*b* from FIGS. 1-16, the anchor mechanisms with anchor mechanism bodies 310*a*,310*b* from FIGS. 3A and 3B, the loop and anchor system described with regard to FIGS. 5A and 5B, or the anchor mechanisms with anchor mechanism bodies 610*a*,610*b* from FIGS. 6A and 6B, could be utilized with the pillow body 1202.

Figure 8:
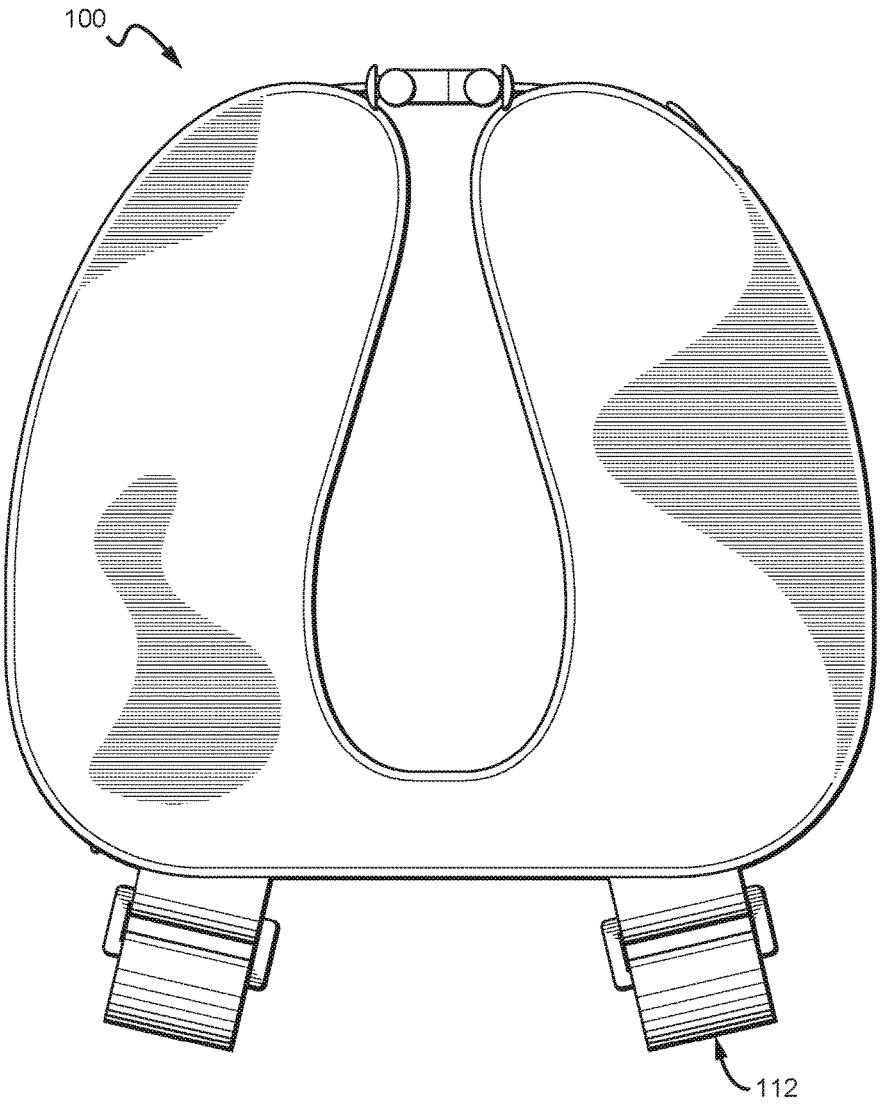
FIG. 8 is a bottom view of the travel pillow shown in FIG. 1.
Figure 9:
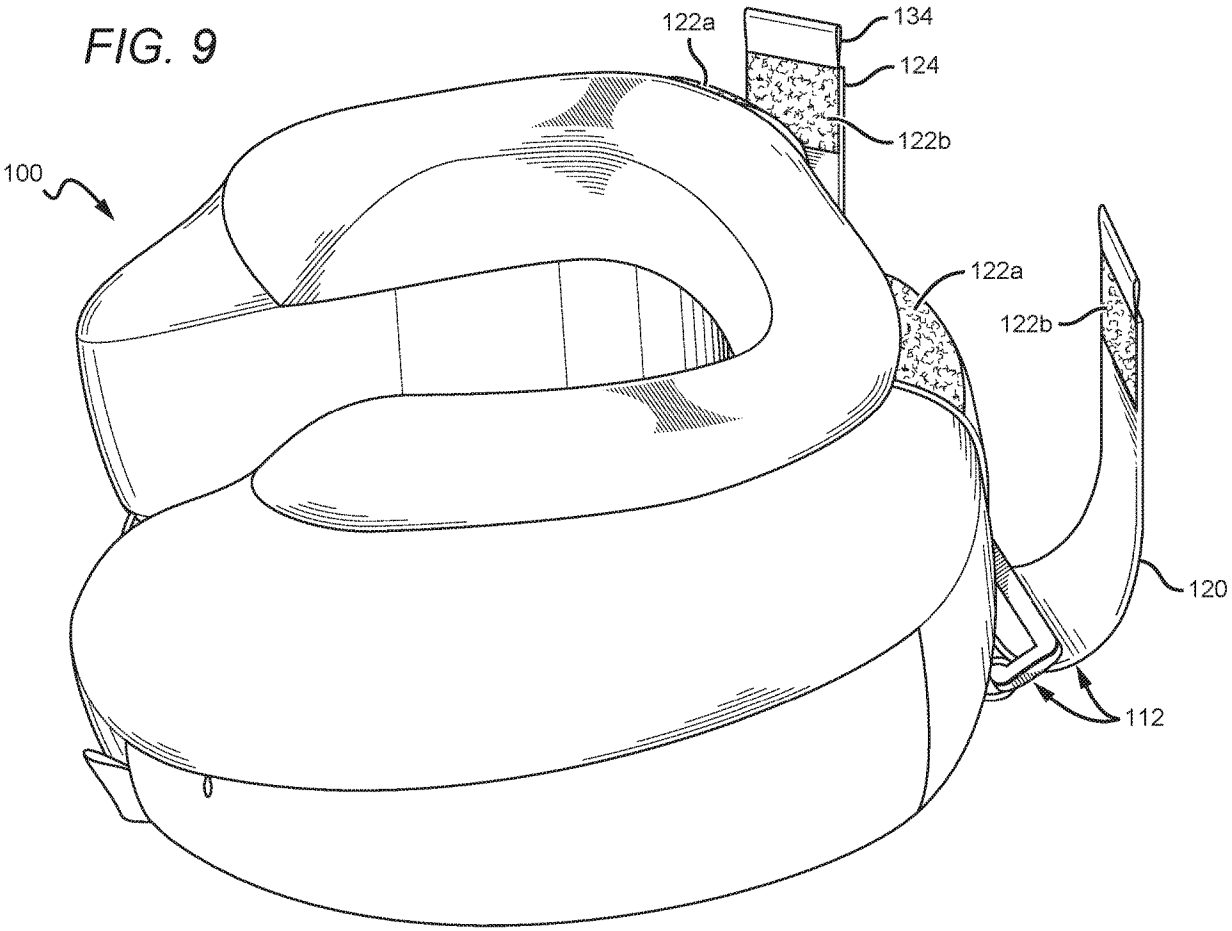
FIGS. 9-16 are front perspective, rear perspective, front, rear, left side, right side, top, and bottom views, respectively, of the travel pillow shown in FIG. 1, in a second configuration.
Figure 10:
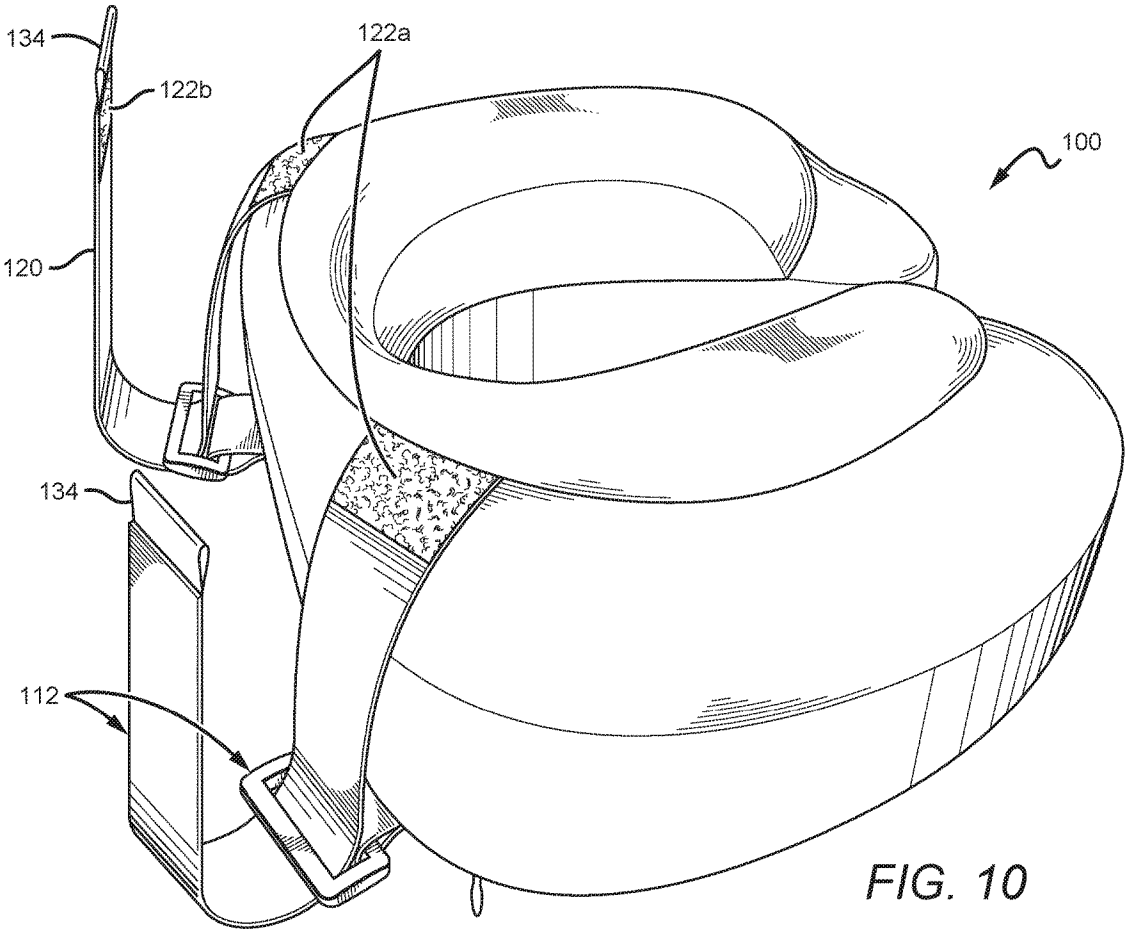
Figure 11:
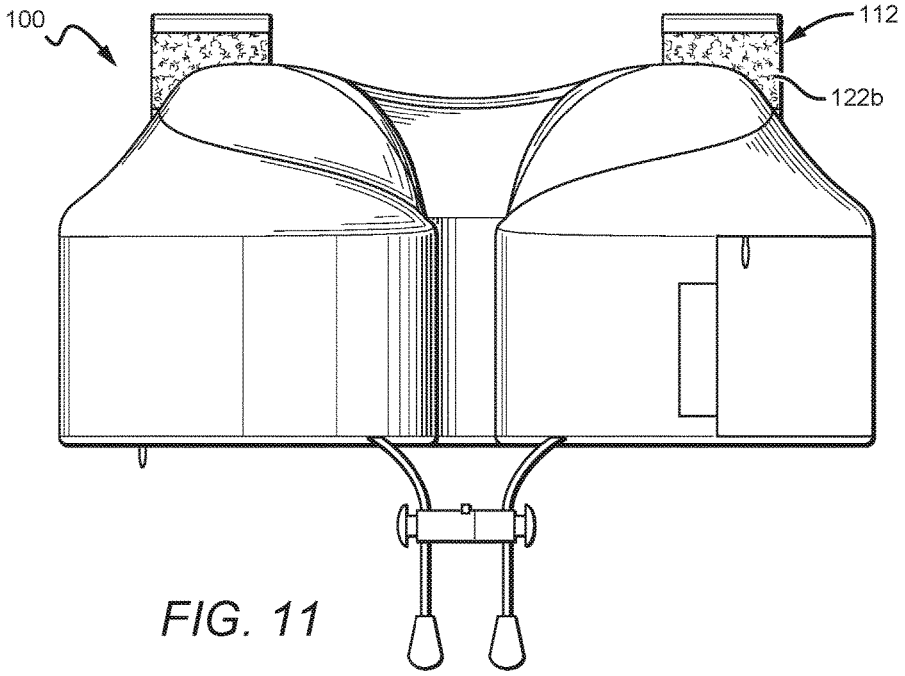
Figure 12:
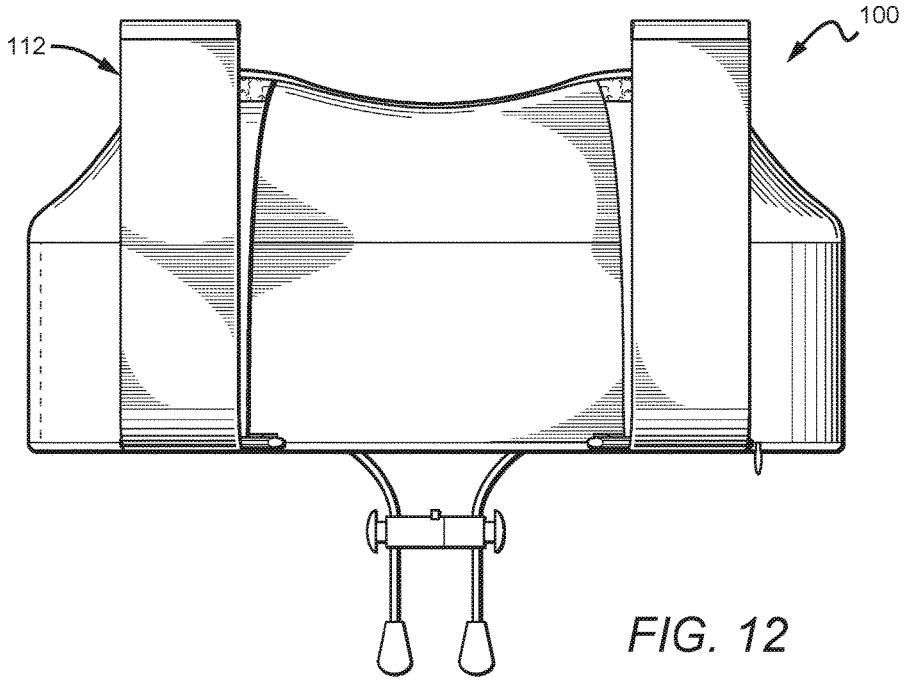
Figure 13:
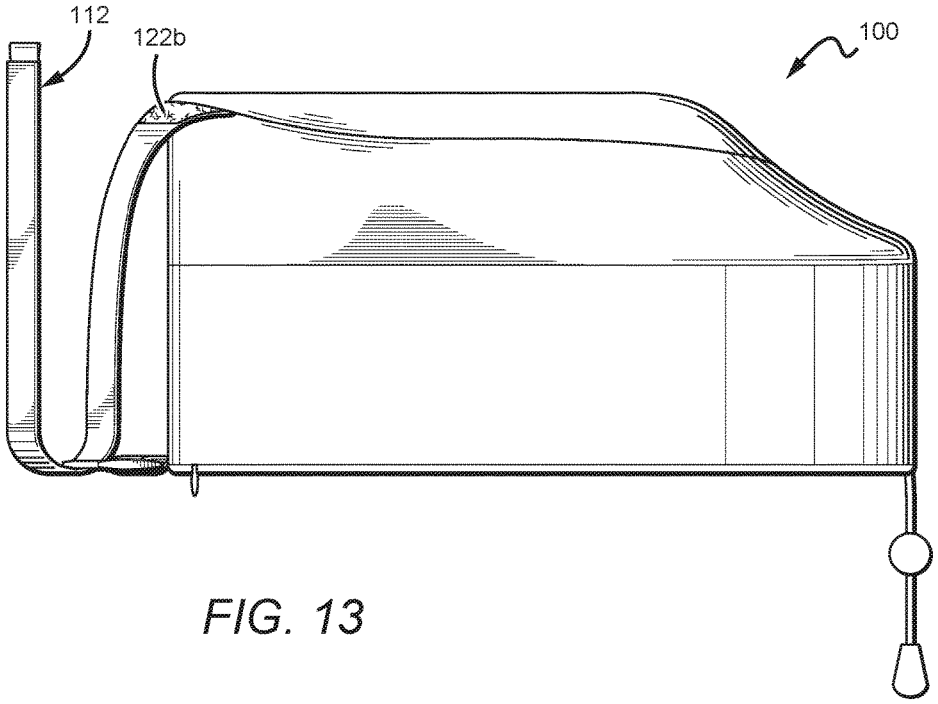
Figure 14:
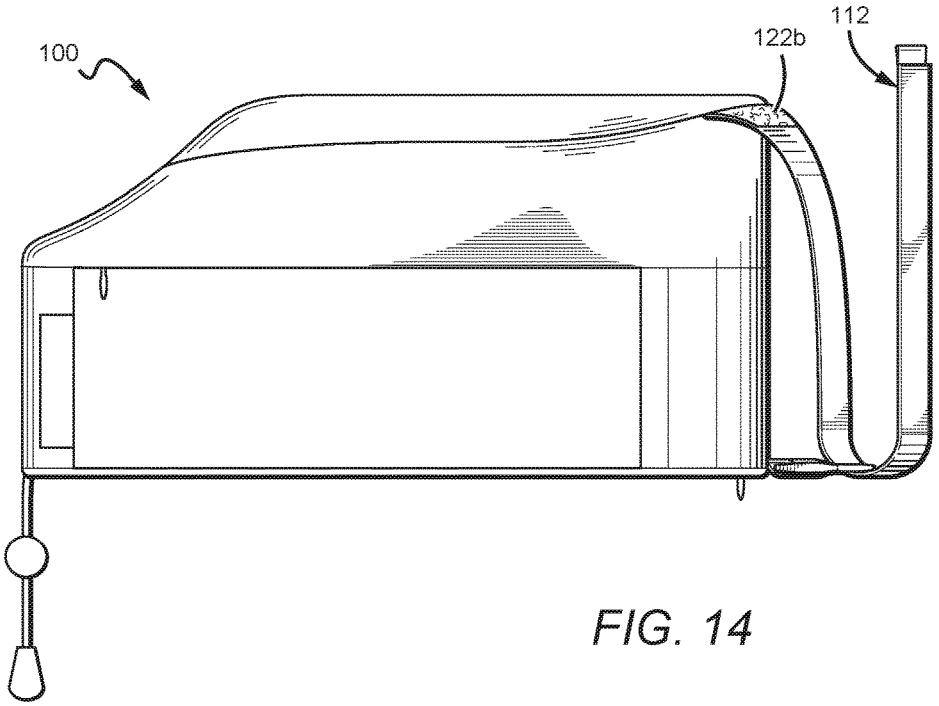
Figure 15:
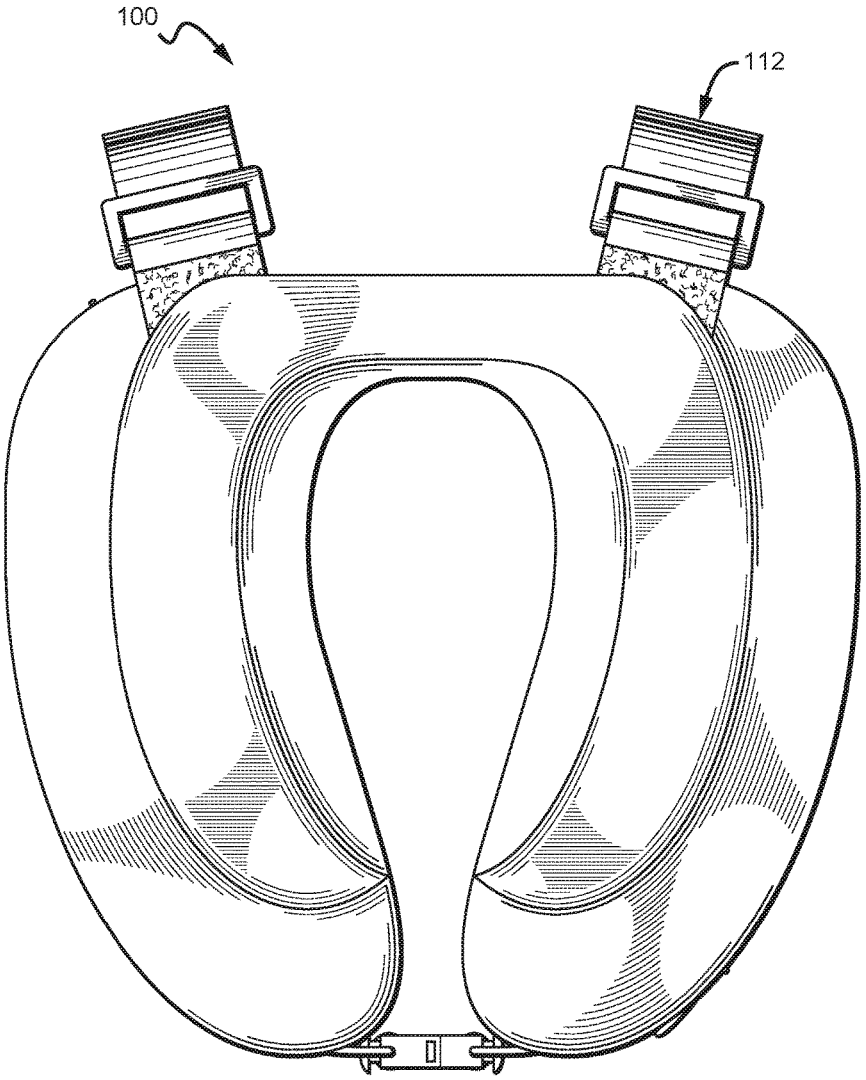
Figure 16:
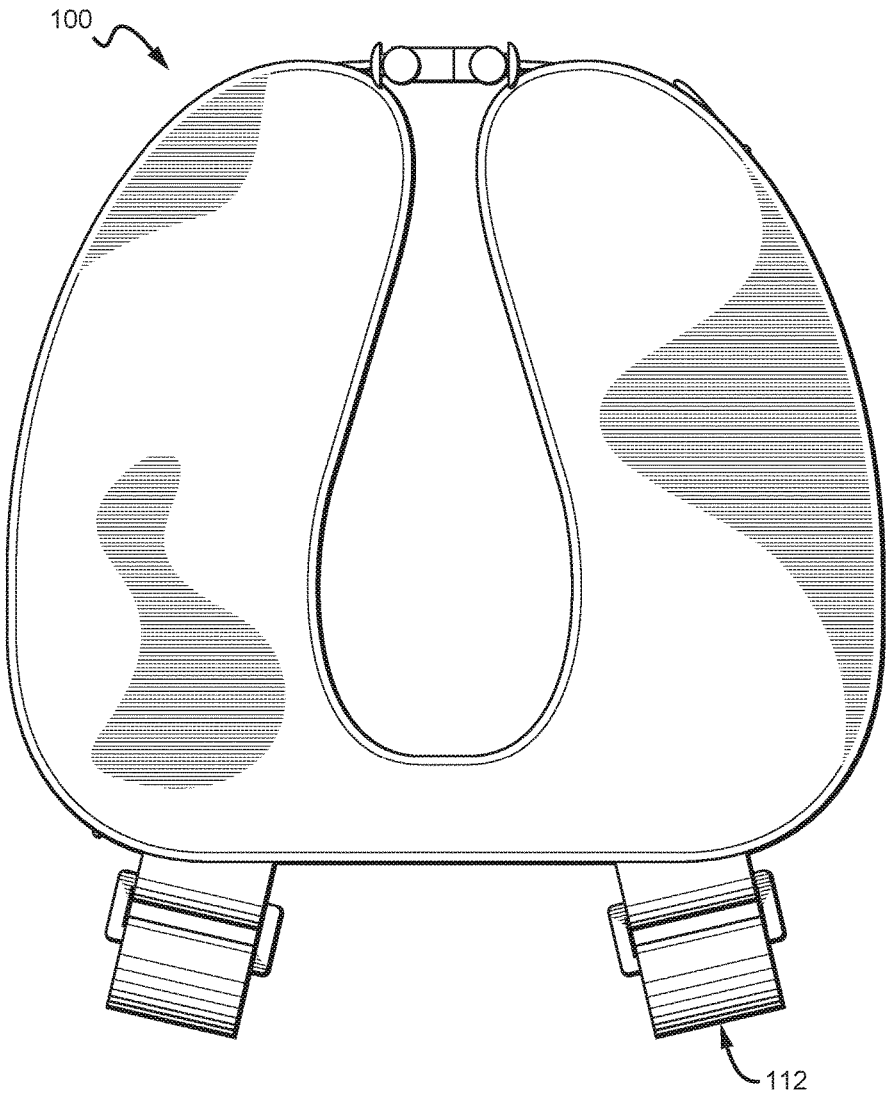

Additionally, the different material concepts described with regard to FIG. 8 can also be utilized with other pillow bodies. For example, the body 1202 could include a cover, and the protrusions 1202*a*,1202*b* could correspond to a second region as previously described, while the remainder of a cover over the body 1202 could correspond to the first region. Many different embodiments and region arrangements are possible.

It is understood that various attributes and elements of from any one embodiment can also be included in other embodiments. Although the present disclosure has been described in detail with reference to certain preferred configurations thereof, other versions are possible. The actual scope of the disclosure encompasses not only the disclosed embodiments, but also all equivalent ways of practicing or implementing the disclosure. The above detailed description of the embodiments of the disclosure is not intended to be exhaustive or to limit the disclosure to the precise form disclosed above or to the particular field of usage mentioned in this disclosure. While specific embodiments of, and examples for, the disclosure are described above for illustrative purposes, various equivalent modifications are possible within the scope of the disclosure, as those skilled in the relevant art will recognize. The elements and acts of the various embodiments described above may be combined to provide further embodiments. Further, the teachings of the disclosure provided herein may be applied to products and systems other than travel pillows.

We claim:

1. A travel pillow, comprising:

a pillow body;

a first anchor mechanism comprising a first anchor mechanism body and a first loop, said first anchor mechanism body and said first loop each connected to said pillow body; and a second anchor mechanism comprising a second anchor mechanism body and a second loop, said second anchor mechanism body and said second loop each connected to said pillow body;

wherein each of said first and second anchor mechanisms is substantially vertically oriented; and wherein each of said first anchor mechanism body and said second anchor mechanism body further comprises a first portion configured to pass through said respective loop and connect to a second portion of the respective anchor mechanism body.

2. The travel pillow of claim 1, wherein said first and second anchor mechanism bodies are attached to said pillow body above where said first and second loops are attached to said pillow body.

3. The travel pillow of claim 1, wherein said first and second anchor mechanism bodies are attached to said pillow body at a top of said pillow body, and said first and second loops are attached to said pillow body at a bottom of said pillow body.

4. The travel pillow of claim 1, wherein said first and second anchor mechanism bodies and said first and second loops are attached to a rear of said pillow body.

5. The travel pillow of claim 1, wherein for each of the first anchor mechanism and the second anchor mechanism, each of said first and second portions of the respective anchor mechanism body further comprises a fastener, and the fastener of the first portion of the respective anchor mechanism is configured to pass through the respective loop of the anchor mechanism such that the fastener of the first portion of the respective anchor mechanism connects to the fastener of the second portion of the respective anchor mechanism.

6. The travel pillow of claim 5, wherein said fasteners are hook-and-loop fasteners.

7. The travel pillow of claim 1, wherein said pillow body includes one or more rear walls, two or more side walls, and two or more curved transition walls, and wherein each of said anchor mechanism bodies is attached to at least one of said rear walls and at least one of said curved transition walls.

8. The travel pillow of claim 1, wherein said first anchor mechanism body and said second anchor mechanism body are elastic.

9. The travel pillow of claim 1, wherein each of said first anchor mechanism body and said second anchor mechanism body is a strap.

10. The travel pillow of claim 9, wherein each of said first anchor mechanism body and said second anchor mechanism body is between 6" and 16" long.

11. The travel pillow of claim 9, wherein each of said first anchor mechanism body and said second anchor mechanism body is between ½" and 3" wide.

12. A travel pillow cover comprising:

a cover body;

two vertically oriented anchor mechanism bodies, each of said anchor mechanism bodies attached to said cover body at a respective static attachment point; and two loops attached to said cover body, wherein each of said anchor mechanism bodies comprises a first portion configured to pass through one of said loops and around a seatback headrest wing before attaching to at least one of a second portion of the anchor mechanism body and the cover body.

13. The travel pillow body of claim 12, wherein said static attachment points are above where said loops are attached to said cover body.

14. The travel pillow cover of claim 12, further comprising two fasteners on each of said anchor mechanism bodies, the two fasteners on each of said anchor mechanism bodies being distal from one another.

15. The travel pillow cover of claim 14, wherein the two fasteners of each of said anchor mechanism bodies are configured to connect to one another.

16. The travel pillow cover of claim 12, wherein said anchor mechanism bodies are elastic straps.

17. The travel pillow cover of claim 12, wherein each of said anchor mechanism bodies is attached at least partially to a rear of said cover body.

18. A travel pillow, comprising:

a travel pillow body comprising:

a memory foam core; and a cover over said memory foam core;

a first anchor mechanism attached at least partially to said cover, said first anchor mechanism comprising:

a first anchor mechanism body attached to said cover; and a first loop attached to said cover, wherein a first portion of said first anchor mechanism body is configured to pass through said first loop before attaching to a second portion of the first anchor body mechanism;

a second anchor mechanism attached at least partially to said cover, said second anchor mechanism comprising:

a second anchor mechanism body attached to said cover; and a second loop attached to said cover, wherein a first portion of said second anchor mechanism body is configured to pass through said second loop before attaching to a second portion of the second anchor mechanism body;

wherein said first and second anchor mechanism bodies are angled at least slightly outward and away from one another.

19. The travel pillow of claim 18, wherein said first anchor mechanism body is attached to a top of said cover at a first seam of said cover; said first loop is attached to a bottom of said cover at a second seam of said cover; said second anchor mechanism body is attached to said top of said cover at said first seam of said cover; and said second loop is attached to said bottom of said cover at said second seam of said cover.

* * * * *